US008540241B2

(12) United States Patent
Sugahara

(10) Patent No.: US 8,540,241 B2
(45) Date of Patent: Sep. 24, 2013

(54) SHEET END DETECTION DEVICE, IMAGE RECORDING APPARATUS INCLUDING THE SHEET END DETECTION DEVICE, AND A METHOD FOR DETECTING POSITION OF SHEET

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 407 days.

(21) Appl. No.: 12/326,062

(22) Filed: Dec. 1, 2008

(65) Prior Publication Data

US 2009/0212490 A1 Aug. 27, 2009

(30) Foreign Application Priority Data

Nov. 30, 2007 (JP) ..... 2007-310043

(51) Int. Cl.
*B65H 7/02* (2006.01)

(52) U.S. Cl.
USPC ..... 271/265.01; 271/272

(58) Field of Classification Search
USPC ..... 271/272, 265.01
See application file for complete search history.

(56) References Cited

U.S. PATENT DOCUMENTS

| | | | | |
|---|---|---|---|---|
| 5,048,353 | A * | 9/1991 | Justus et al. | 73/862.55 |
| 5,572,309 | A | 11/1996 | Nishio et al. | |
| 5,592,875 | A * | 1/1997 | Moschel | 100/99 |
| 6,293,539 | B1 * | 9/2001 | Fukatsu et al. | 271/126 |
| 6,731,886 | B2 * | 5/2004 | Takeda | 399/45 |
| 6,769,314 | B2 * | 8/2004 | Moore et al. | 73/862.55 |
| 6,988,398 | B2 * | 1/2006 | Saloniemi et al. | 73/159 |
| 7,225,688 | B2 * | 6/2007 | Moore et al. | 73/862.55 |
| 2007/0006644 | A1 * | 1/2007 | Schultheis | 73/159 |
| 2010/0071480 | A1 * | 3/2010 | Pietikainen et al. | 73/862.55 |

FOREIGN PATENT DOCUMENTS

| | | | |
|---|---|---|---|
| JP | H11-092647 | A | 8/1989 |
| JP | H05-035314 | U | 5/1993 |
| JP | H07-177296 | A | 7/1995 |
| JP | H07-215528 | A | 8/1995 |
| JP | 2001-100548 | A | 4/2001 |
| JP | 2001-255112 | A | 9/2001 |

OTHER PUBLICATIONS

Japan Patent Office, Office Action for Japanese Patent Application No. 2007-310043, dispatched Oct. 18, 2011.

Japan Patent Office, Decision of Patent Grant for Japanese Patent Application No. 2007-310043above-captioned, dispatched Jan. 31, 2012.

* cited by examiner

*Primary Examiner* — Kaitlin Joerger
*Assistant Examiner* — Ernesto Suarez
(74) *Attorney, Agent, or Firm* — Baker Botts L.L.P.

(57) ABSTRACT

A sheet end detection device includes a cylindrical roller rotatable around an axis; and a phase detection unit configured to detect a phase in a circumferential direction of the roller. A first piezoelectric element band is provided on the peripheral surface of the roller and extending in the circumferential direction and the axial direction, and the first piezoelectric element band is configured to detect a contact of the sheet and extending in an axial direction of the roller over an inside and an outside of a contact area to be contacted with the conveyed sheet on the peripheral surface. A position of an arbitrary point of the first piezoelectric element band in the axial direction of the roller corresponds one-to-one with the phase in the circumferential direction of the roller.

16 Claims, 14 Drawing Sheets

SHEET END DETECTION DEVICE, IMAGE RECORDING APPARATUS INCLUDING THE SHEET END DETECTION DEVICE, AND A METHOD FOR DETECTING POSITION OF SHEET

CROSS-REFERENCE TO RELATED APPLICATIONS

This application is based upon and claims priority from Japanese Patent Application No. 2007-310043 filed on Nov. 30, 2007, the entire contents of which are incorporated herein by reference.

TECHNICAL FIELD

This invention relates to a sheet end detection device for detecting an end of a sheet such as a recording sheet to be conveyed, an image recording apparatus including the sheet end detection device, and a method for detecting an end position of a conveyed sheet using the sheet end detection device.

BACKGROUND

An image recording apparatus for forming an image on a recording sheet, such as an ink jet printer needs to precisely keep track of the position of a sheet end to form an image at any desired position on the plane (space) of the recording sheet. Particularly, there has been a need for more precisely keeping track of the position of a sheet end in borderless printing of a photo, etc., needed increasingly in recent years. That is, in the borderless printing, a predetermined margin is provided from the sheet end of a recording sheet, and a slightly wider print area is set than the area of the recording sheet, thereby forming an image with no blank at the sheet ends. At this time, since the print area which is set for the borderless printing includes an outside area of the recording sheet, ink is also ejected to the outside area of the recording sheet and is not supplied to image formation, which goes to waste and makes dirt the periphery of a platen for supporting the recording sheet, etc. For the image formed on the recording sheet, the surrounding image is lost. In contrast, it the position of a sheet end can be kept track of more precisely, the margin size can be decreased, and the area of the recording sheet and the set print area can be more matched with each other. Therefore, waste of ink, occurrence of peripheral contamination, loss of the surrounding image, and the like as described above can be suppressed.

To detect an end part of a recording sheet, a method of providing a moving arm at a midpoint in a conveying passage of a recording sheet, detecting fluctuation of the moving arm caused by contact with the conveyed recording sheet with an infrared sensor, and detecting the leading end of the recording sheet has been known. However, when the recording sheet is conveyed in a floating attitude from the conveying passage in a direction normal to the sheet plane, a timing of contacting with the arm varies, and the thickness and the material of the recording sheet, etc., have an influence on the detection accuracy. Therefore, it is difficult to improve the detection accuracy. Further, in the method, the sheet end in the direction orthogonal to the conveying direction of the recording sheet (side end) cannot be detected.

JP-A-7-215528 (especially, FIG. 10 of this reference) describes a configuration wherein a roller-shaped conductive electrode and a piezoelectric element group provided on a conveying passage of a recording sheet. The piezoelectric element group includes a plurality of piezoelectric elements facing the electrode and arranged along the sheet width direction and being independent of one another. In this configuration, when the conveyed recording sheet enters the space between the electrode and the piezoelectric element group, a signal is output from the piezoelectric element group in response to the width dimension of the recording sheet, and the position of a side end of the recording sheet can be detected.

However, in the configuration according to JP-A-7-215528, the piezoelectric element group including six piezoelectric elements is disclosed in an embodiment, and thus the position of a side end of the recording sheet can be detected in only six ways and the detection accuracy is low. Although the detection accuracy can be improved by increasing the number of arranged piezoelectric elements, a considerable number of minute piezoelectric elements independent of one another need to be provided to realize the detection accuracy at a level demanded in the borderless printing as described above; it is not realistic considering the labor and the cost at the manufacturing time.

Such circumstances is applied not only to the ink jet printer, but also to other printers such as a thermal printer, etc., and a copier and a facsimile machine. Further, in addition to a recording sheet to record an image, to detect the position of a sheet with an image recorded thereon in a scanner for reading an image and converting it into an electric signal, it is also necessary to precisely detect an end position of the sheet; similar circumstances to those described above exist.

SUMMARY

It is therefore an object of the invention to provide a sheet end detection device that can be easily manufactured and can suppress the manufacturing cost while more precisely detecting the end position (particularly, side end position) of a sheet to be conveyed such as a recording sheet, an image recording apparatus including the sheet end detection device, and a method for detecting an end position of a sheet using the sheet end detection device.

According to a first aspect of the invention, there is provided A sheet end detection device comprising: a cylindrical roller rotatable around an axis with conveying of a sheet to be conveyed in a state in which a peripheral surface of the roller contacts one face of the conveyed sheet; and a phase detection unit configured to detect a phase in a circumferential direction of the roller, wherein a first piezoelectric element band is provided on the peripheral surface of the roller and extending in the circumferential direction and the axial direction, the first piezoelectric element band being configured to detect a contact of the sheet and extending in an axial direction of the roller over an inside and an outside of a contact area to be contacted with the conveyed sheet on the peripheral surface, and wherein a position of an arbitrary point of the first piezoelectric element band in the axial direction of the roller corresponds one-to-one with the phase in the circumferential direction of the roller.

According to a second aspect of the invention, there is provided an image recording apparatus comprising: a sheet end detection device according to the first aspect of the invention; and a recording head for ejecting ink to a recording sheet as the conveyed sheet to form an image, wherein the roller is provided at a midpoint in the conveying passage of the sheet to be conveyed.

According to a third aspect of the invention, there is provided a method for detecting an end position of a sheet using the sheet end detection device according to the first aspect, said method comprising: detecting the phase of the roller by the phase detection unit; detecting a contact state indicating whether the first piezoelectric element band with the sheet; detecting the end position of the sheet in a direction orthogonal to the conveying direction by, when the first piezoelectric element band detects change in the contact state, a position of the roller in the axial direction at which the contact state is changed based on the phase of the roller detected by the phase detection unit.

BRIEF DESCRIPTION OF THE DRAWINGS

FIG. 1 shows a multifunction device as the image recording apparatus;

FIG. 9(*a*) is a front view and 9(*b*) is a drawing of developing a peripheral surface of a conveying roller that the sheet end detection unit has;

FIG. 12(*a*) is a front view and 12(*b*) is a drawing of developing a peripheral surface of a conveying roller that the sheet end detection unit has;

FIG. 13(*a*) is a front view and 13(*b*) is a drawing of developing a peripheral surface of a conveying roller that the sheet end detection unit has;

FIG. 14(*a*) is a front view and 14(*b*) is a drawing of developing a peripheral surface of a conveying roller that the sheet end detection unit has;

DESCRIPTION

An image recording apparatus including a sheet end detection device according to an embodiment of the invention will be discussed specifically below with reference to the accompanying drawings.

(Image Recording Apparatus)

Figure 1:
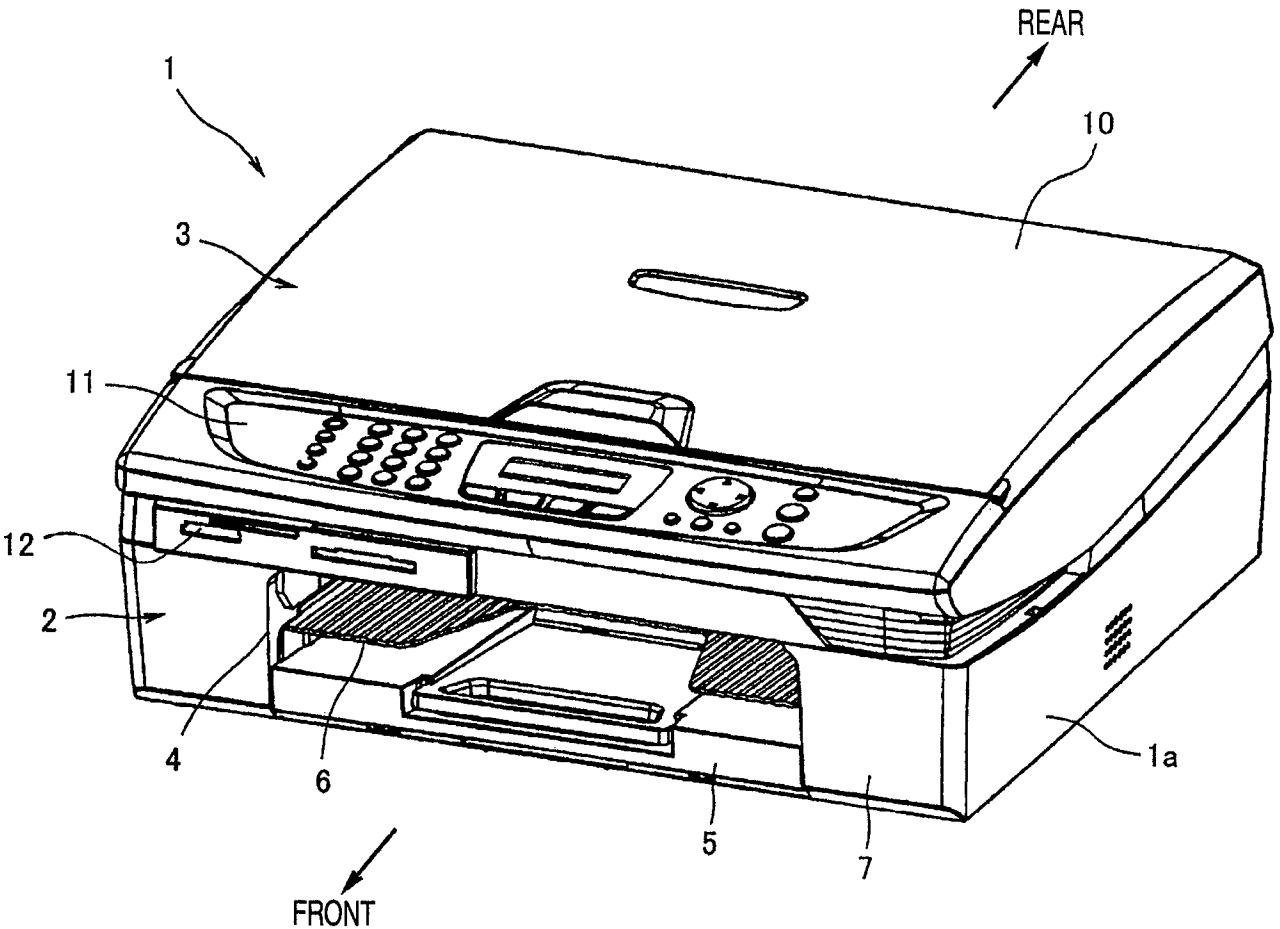
FIG. 1 is a perspective view to show the external configuration of an image recording apparatus according to an embodiment of the invention; in the embodiment.

FIG. 1 is a perspective view to show the external configuration of an image recording apparatus 1 according to the embodiment of the invention. In the embodiment, a multifunction device is shown as the image recording apparatus 1. As shown in FIG. 1, the image recording apparatus 1 is a multifunction device including a printer unit 2 for recording an image according to an ink jet system in a lower part of a cabinet 1*a* shaped roughly like a rectangular parallelepiped and a scanner unit 3 in an upper part of the cabinet 1*a* and has a printer function, a scanner function, a copy function, and a facsimile function.

The image recording apparatus 1 is connected to an external information machine such as a personal computer and records an image of text, a photo, a paint graph, etc., on a recording sheet P as a recording sheet based on data transmitted from the computer, etc. To connect a digital camera, etc., to the image recording apparatus 1, the image recording apparatus 1 can also record a photo on a recording sheet P based on data output from the digital camera, etc.; to place any storage medium of a memory card, etc., in the image recording apparatus 1, the image recording apparatus 1 can also record an image on a recording sheet P based on data recorded on the storage medium. To record an image of a photo, etc., borderless printing with no blank in a margin of a recording sheet P can be executed.

As shown in FIG. 1, the printer unit 2 included in the image recording apparatus 1 has an opening on the front and a lower sheet feed tray 5 and an upper sheet discharge tray 6 are provided at two stages in the opening 4. A plurality of recording sheets P can be housed in the sheet feed tray 5; for example, a plurality of recording sheets P of various sizes of A4 size and the smaller sizes can be housed.

A door 7 is provided in the lower right portion of the front of the printer unit 2 as it can be opened and closed. Provided inside with the door 7 open is a housing room in which a main tank (ink cartridge) 9 (see FIG. 2) can be installed. The housing rooms are provided in a one-to-one correspondence with ink colors to be used; in the printer unit 2, they are provided in a one-to-one correspondence with the main tanks of five color inks, namely, cyan (C), magenta (M), yellow (Y), and photo black (PBk) of dye ink and black (Bk) of pigmented ink.

The scanner unit 3 provided in the upper part of the image recording apparatus 1 is implemented as a flatbed scanner.

That is, as shown in FIG. 1, a document cover 10 that can be opened and closed as a top plate of the image recording apparatus 1 is provided on the top face of the image recording apparatus 1. Platen glass on which a document is to be placed, an image sensor for reading an image of a document, and the like are disposed below the document cover 10.

An operation panel 11 for operating the printer unit 2 and the scanner unit 3 is provided on the front top of the image recording apparatus 1. The operation panel 11 includes various operation buttons and a liquid crystal display and the image recording apparatus 1 can operate based on a command output from the operation panel 11 as the user operates the operation panel 11. If the image recording apparatus 1 is connected to an external computer, the image recording apparatus 1 also operates based on a command transmitted from the computer through a printer driver or a scanner driver.

A slot unit 12 is provided in the upper left portion of the front of the image recording apparatus 1. Any of various small memory cards of storage media can be placed in the slot unit 12. The user performs predetermined operation through the operation panel 11, whereby data stored on the small memory card placed in the slot unit 12 can be read. The read data can also be displayed on the liquid crystal display of the operation panel 11 and any image selected based on the display can be recorded on a recording sheet P on the printer unit 2.

Figure 2:
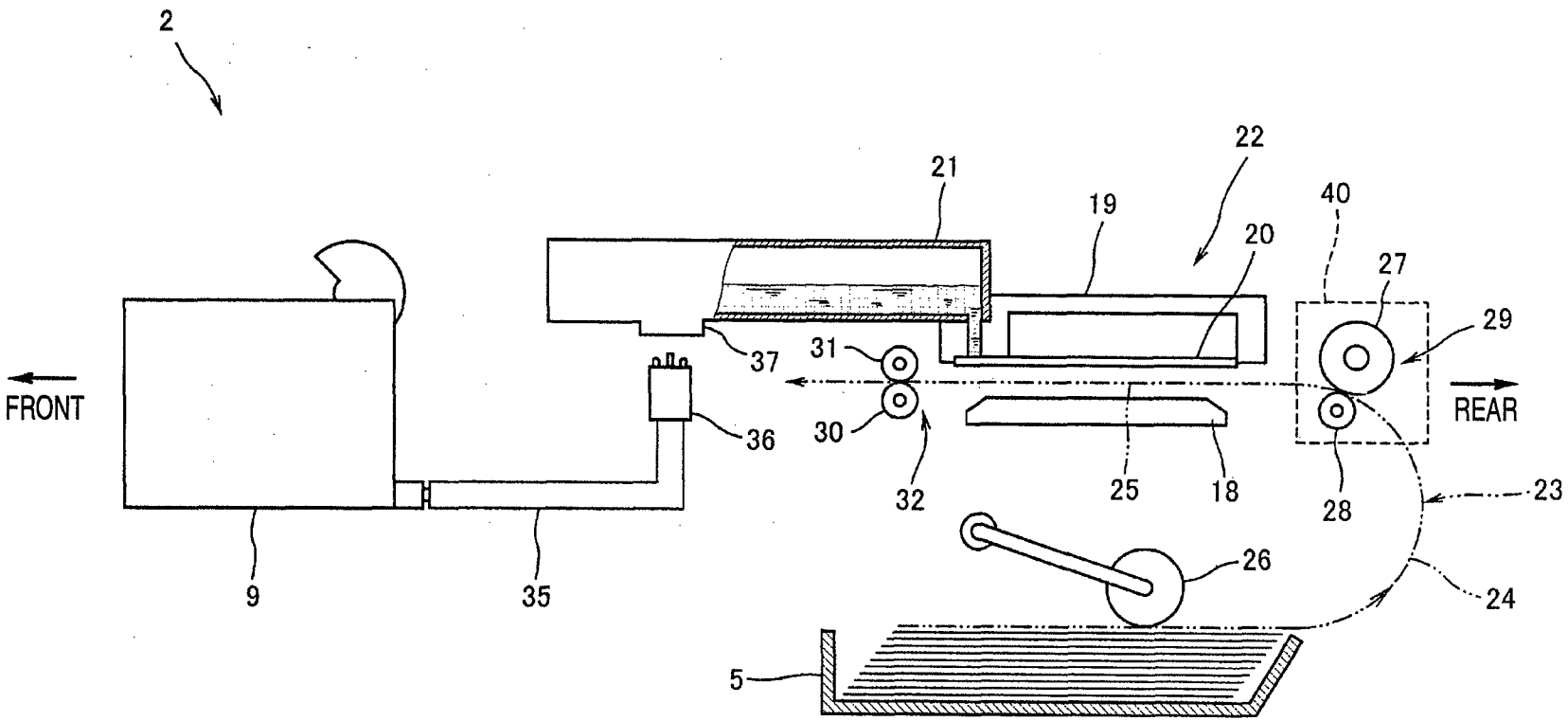
FIG. 2 is a schematic sectional view to show the configuration of a printer unit included in the image recording apparatus.

FIG. 2 is a schematic sectional view to show the configuration of the printer unit 2. As shown in FIG. 2, the sheet feed tray 5 is provided in the proximity of the bottom of the image recording apparatus 1 and a platen 18 is provided above the sheet feed tray 5. An image recording unit 22 having a recording head 20 for ejecting ink toward a recording sheet P, a subtank 21, etc., mounted on a carriage 19 is provided above the platen 18. A conveying passage 23 of a recording sheet P is extended from the rear portion of the sheet feed tray 5. The conveying passage 23 includes a bend path 24 going upward from the rear portion of the sheet feed tray 5, bending toward the front, and extending to an upstream position of the image recording unit 22 and a straight path 25 extending from the end point of the bend path 24 to the front; it is formed of an outer guide wall and an inner guide wall opposed to each other with a predetermined spacing in any other portion than the disposition place of the image recording unit 22.

A sheet feed roller 26 for feeding a recording sheet P in the sheet feed tray 5 to the conveying passage 23 is provided just above the sheet feed tray 5. A conveying roller pair 29 including a conveying roller 27 and a driven roller 28 described later is provided so as to sandwich the conveying passage 23 from up and down between the rollers 27 and 28 in the proximity of the downstream portion of the bend path 24 in the conveying passage 23. The conveying roller pair 29 forms apart of a sheet end detection unit 40 for detecting an end part position of a recording sheet P as described later (also see FIG. 3).

Further, a sheet discharge roller pair 32 including a sheet discharge roller 30 and a pinch roller 31 is provided so as to sandwich the conveying passage 23 from up and down between the rollers 30 and 31 in the proximity of the downstream portion of the straight path 25 in the conveying passage 23. The recording head 20 and the platen 18 are provided so as sandwich the straight path 25 from up and down between the conveying roller pair 29 and the sheet discharge roller pair 32.

Therefore, a recording sheet P in the sheet feed tray 5 is fed to the conveying passage 23 by the sheet feed roller 26 and subsequently is conveyed from the bend path 24 to the straight path 25 on the conveying passage 23 by the conveying roller pair 29. An image is recorded on the space of the recording sheet P arriving at the straight path 25 in ink ejected from the recording head 20 and upon completion of the recording, the recording sheet P is ejected from the straight path 25 by the sheet discharge roller pair 32 and is housed in the sheet discharge tray 6 (see FIG. 1).

As shown in FIG. 2, the printer unit 2 according to the embodiment adopts a station supply system wherein a joint valve 36 provided at the tip of a tube 35 extending from the main tank 9 and a refill port valve 37 provided in the subtank 21 are joined as required in response to the ink remaining amount in the subtank 21, etc., and the subtank 21 is replenished with ink from the main tank 9. However, the ink supply system is not limited to the station supply system and a system such as a tube supply system wherein the recording head 20 and the main tank 9 are connected at all times through a tube may be adopted.

In the image recording apparatus 1 as described above, the conveying roller pair 29 provided at a midpoint in the conveying passage 23 includes the function of conveying the conveyed recording sheet P further to the downstream portion; in addition, in the embodiment, the conveying roller pair 29 forms a part of the sheet end detection unit 40 for detecting an end part position of the recording sheet P. The configuration of the sheet end detection unit 40 will be discussed below:

(Sheet End Detection Unit)

EXAMPLE 1

Figure 3:
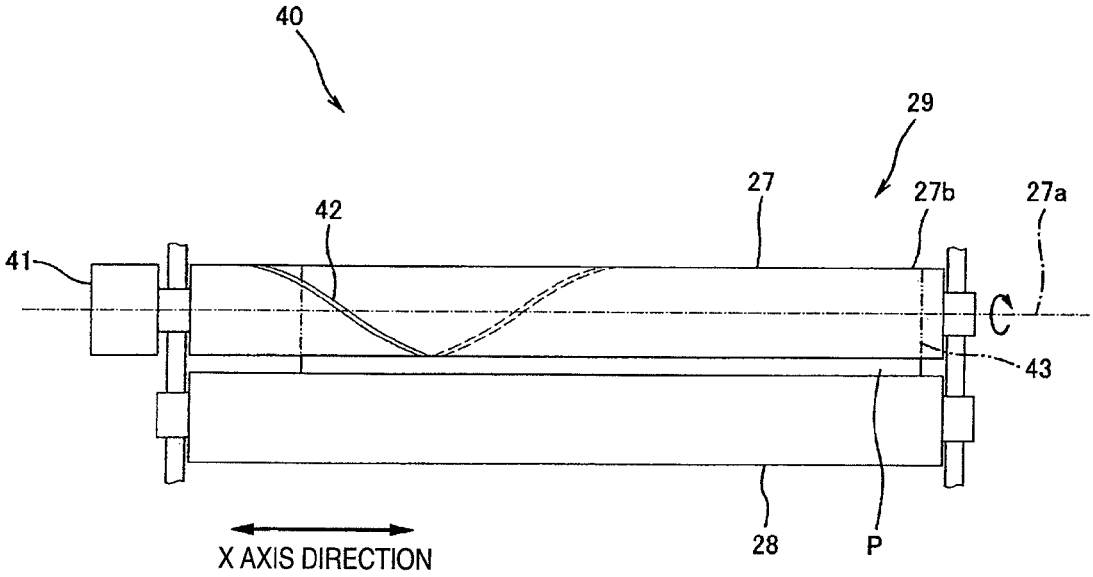
FIG. 3 is a front view to show the configuration of a sheet end detection unit when seen from the front of a conveying roller pair.

FIG. 3 is a front view to show the configuration of the sheet end detection unit 40 when seen from the front of the conveying roller pair 29. As shown in FIG. 3, the sheet end detection unit 40 includes the conveying roller 27 and the driven roller 28 disposed up and down and making up the conveying roller pair 29, and is provided with an encoder 41 for detecting a phase around an axis 27*a* of the conveying roller 27 in one end part of the upper conveying roller 27. More particularly, the encoder 41 can detect a phase (angle) difference between a point on the peripheral surface of the conveying roller 27 in contact with the recording sheet P at any point in time (in other words, a point opposed to the driven roller 28) and a reference point set at a predetermined position around the axis 27*a*.

Figure 4:
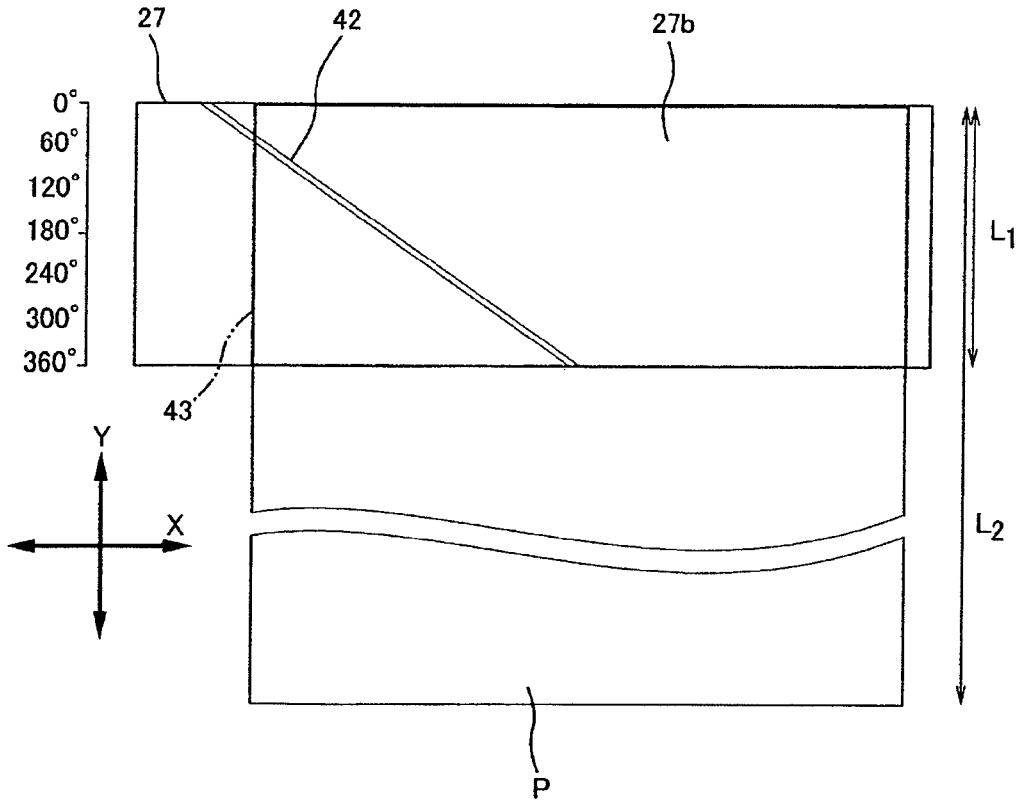
FIG. 4 is a developed view of a peripheral surface of a conveying roller and shows the peripheral surface developed at a point where the phase detected by an encoder becomes zero.

The conveying roller 27 is provided on a-peripheral surface 27*b* with a first piezoelectric element band 42. FIG. 4 is a developed view of the peripheral surface 27*b* of the conveying roller 27 and shows the peripheral surface 27*b* developed at a point where the phase detected by the encoder 41 becomes zero. As shown in the developed view, an outer peripheral dimension $L_1$ (Y axis direction dimension in FIG. 4) of the conveying roller 27 is a half or less of a conveying direction dimension $L_2$ (Y axis direction dimension) of the recording sheet P. The first piezoelectric element band 42 extends linearly so as to incline relative to a circumferential direction (Y axis direction in FIG. 4) of the conveying roller 27. Therefore, as shown in FIG. 3, the first piezoelectric element band 42 extends so as to make one round around the axis 27*a* while going in the direction along the axis 27*a* (X axis direction in FIG. 3, 4) on the peripheral surface 27*b* of the cylindrical conveying roller 27 and consequently is provided so as to become spiral around the axis 27*a*. According to the configuration, at an arbitrary point in the extension direction of the first piezoelectric element band 42, the position in the direction along the axis 27*a* and the phase around the axis 27*a* are in a one-to-one correspondence with each other.

When the recording sheet P conveyed on the conveying passage 23 goes as it is sandwiched between the conveying roller 27 and the driven roller 28, it passes through a position to one side in the direction of the axis 27*a* and a contact area 43 (area surrounded by the alternate long and two short dashes line in FIG. 4) between the conveying roller 27 and the recording sheet P exists at the position. In contrast, the first piezoelectric element band 42 is provided at a position to an opposite side in the direction of the axis 27*a*. the first piezoelectric element band 42 according to example 1 is formed so that a position on the first piezoelectric element band 42 opposed to the conveying passage 23 makes a transition from an outer portion of the contact area 43 to an inner portion with rotation of the conveying roller 27. In other words, as the phase detected by the encoder 41 becomes larger, the first piezoelectric element band 42 extends from the outer portion of the contact area 43 toward one side in the direction of the axis 27*a* to the inner portion of the contact area 43, as shown in FIG. 4. In this embodiment, the contact area 43 is set such that an error (e.g., an assumed error caused during the conveyance of the recording sheet) is added to the standard size of recording sheet.

Figure 5:
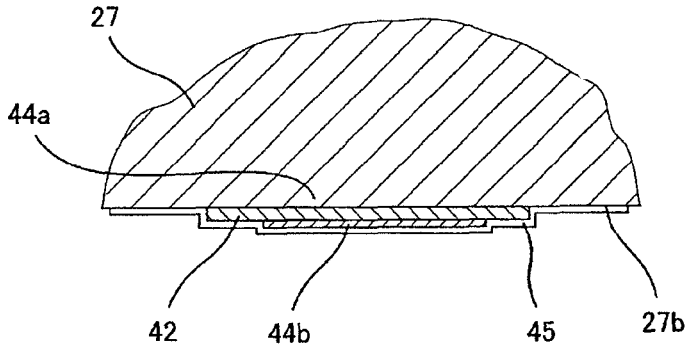
FIG. 5 is a fragmentary sectional view of the conveying roller and shows the configuration of a first piezoelectric element band and the vicinity thereof as a cross section orthogonal to the extension direction of the first piezoelectric element band.

FIG. 5 is a fragmentary sectional view of the conveying roller 27 and shows the configuration of the first piezoelectric element band 42 and the vicinity thereof as a cross section orthogonal to the extension direction of the first piezoelectric element band 42. As shown in FIG. 5, the first piezoelectric element band 42 according to the embodiment includes piezoelectric elements provided by forming a ceramic material of lead-zirconate-titanate (PZT), etc., like a layer having a predetermined thickness dimension on the peripheral surface of the conveying roller 27. Of the conveying roller 27, the peripheral surface 27*b* at least coming in contact with the back of the first piezoelectric element band 42 contains metal and forms one electrode 44*a* of the first piezoelectric element band 42.

A surface electrode extending along the first piezoelectric element band 42 shaped like a metal band is deposited on the surface of the first piezoelectric element band 42 and forms an opposite electrode 44*b* of the first piezoelectric element band 42. Further, an insulating thin film cover 45 containing alumina, etc., is provided so as to cover the first piezoelectric element band 42 and the electrode 44*b*. Therefore, if any point of the first piezoelectric element band 42 is pressed through the cover 45 and the electrode 44*b*, an electromotive force occurs at the pressed point because of the piezoelectric effect and a pulse signal formed by the electromotive force is output through the electrode 44*a*, 44*b*. Such a pulse signal and a detection signal from the encoder 41 are input to a controller 50 included in the image recording apparatus 1.

The first piezoelectric element band 42 containing piezoelectric elements described above can be formed easily on the peripheral surface 27*b* of the conveying roller 27 by an aerosol deposition method (AD method). An outline of the forming method of the first piezoelectric element band 42 by the AD method is given below: The peripheral surface 27*b* of the conveying roller 27 is covered with a mask so as to expose only the area to form the first piezoelectric element band 42, the conveying roller 27 in this state is held in a chamber, and this chamber is decompressed. Next, ceramics material powder entered in a storage vessel is mixed with a carrier gas to produce aerosol material, which is then introduced into a nozzle provided in the decompressed chamber. The aerosol ceramics material powder is ejected at high speed toward the conveying roller 27 from the nozzle using a pressure difference between the chamber inside and the nozzle inside and is brought into collision with the peripheral surface 27*b* to form a film.

The conveying roller 27 is rotated around the axis 27*a* using appropriate drive means while the ceramics material powder is ejected to the conveying roller 27, whereby the ceramics material powder can be brought into collision with the full face of the peripheral surface 27*b* and the first piezoelectric element band 42 can be formed over the overall length where it is required.

Figure 6:
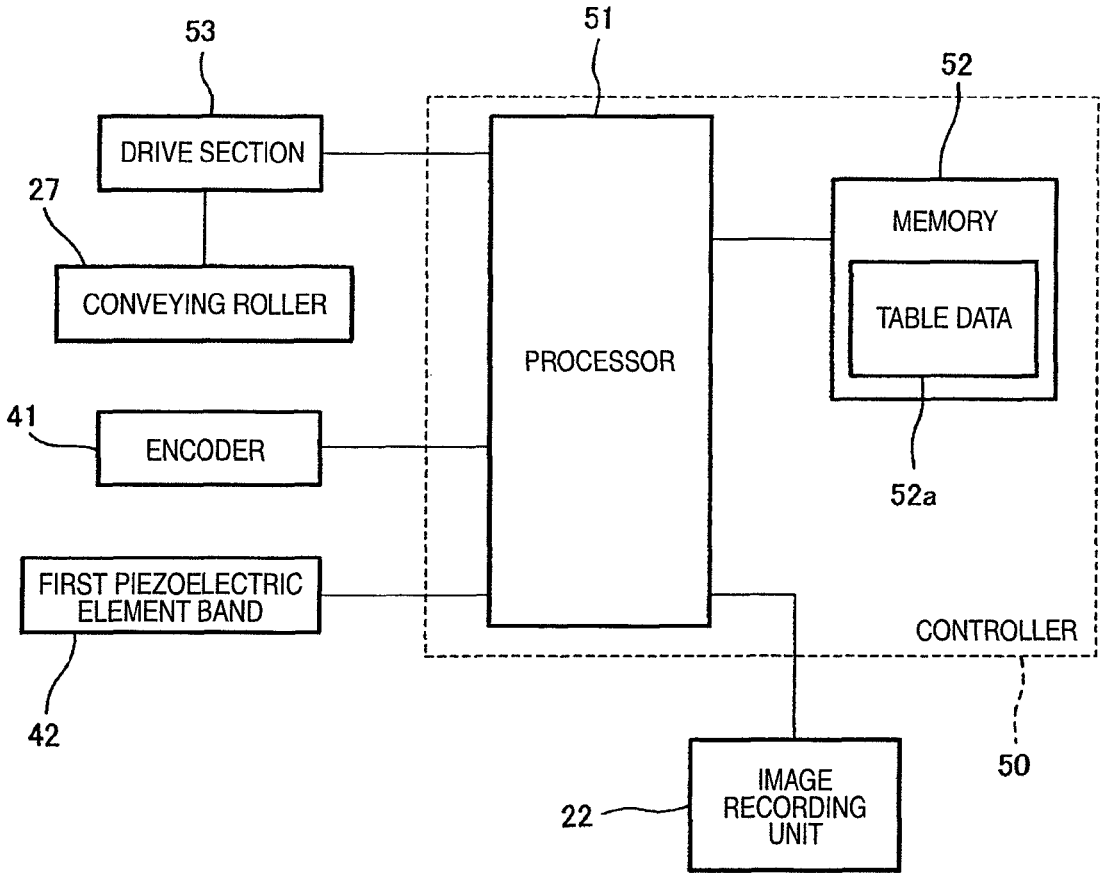
FIG. 6 is a functional block diagram of the image recording apparatus and shows only the configuration involved mainly in the sheet end detection unit.

FIG. 6 is a functional block diagram of the image recording apparatus 1 and shows only the configuration involved mainly in the sheet end detection unit 40. As shown in FIG. 6, the controller 50 includes a processor 51 and memory 52 including RAM, ROM, etc., connected to the processor 51. The external image recording unit 22 is also connected to the processor 51. The memory 52 temporarily stores a signal from the processor 51 and an external input signal and also stores a previously created program. The processor 51 operates in accordance with the program, whereby the image recording apparatus 1 drives the image recording unit 22, etc., and functions as a printer, a scanner, a copier, and a facsimile. Further, the memory 52 includes table data 52*a* associating the phase indicated by the detection signal of the encoder 41 and the side end position of the recording sheet P with each other.

A drive unit 53 including a motor, a driver circuit, etc., is connected to the processor 51. The drive unit 53 drives in accordance with a command from the processor 51, whereby the conveying roller 27 rotates around the axis 27*a* for conveying the recording sheet P along the conveying passage 23. Further, the encoder 41 and the first piezoelectric element band 42 described above are connected to the processor 51. A detection signal from the encoder 41 and a pulse signal from the first piezoelectric element hand 42 are input to the processor 51.

Figure 7:
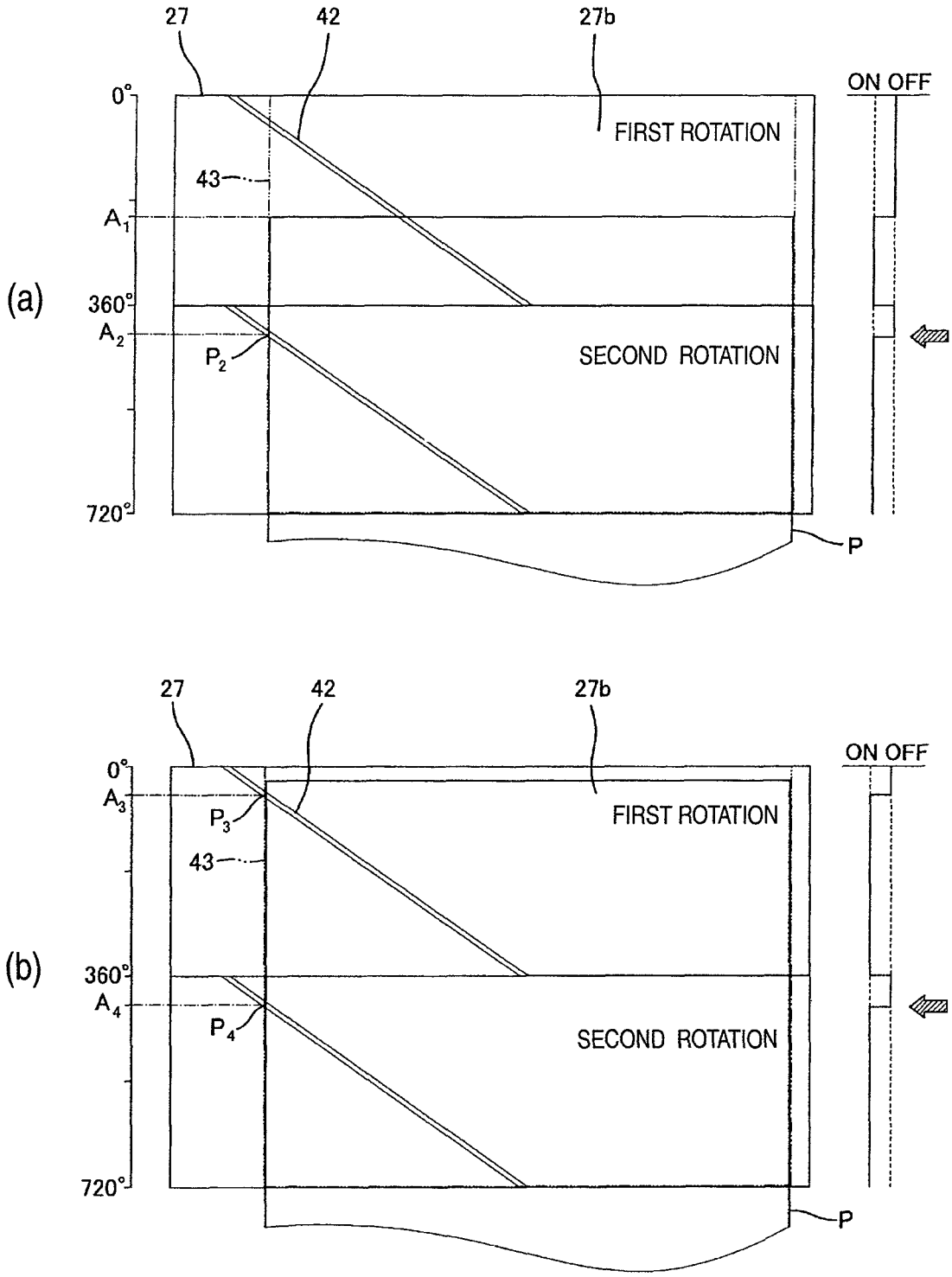
FIG. 7 is a drawing to describe a detection method of a side end position of a recording sheet by the sheet end detection unit and shows the positional relationship between the developed peripheral surface of the conveying roller and a recording sheet for coming in contact with the peripheral surface and a signal output from the first piezoelectric element band.

The sheet end detection unit 40 included in the image recording apparatus 1 having the configuration as described above inserts the recording sheet P conveyed along the conveying passage 23 into the nip between the conveying roller 27 and the driven roller 28 and further conveys the recording sheet P downstream. At this time, the sheet end detection unit 40 detects the side end position of the recording sheet P. The detection method will be discussed below;

FIG. 7 is a drawing to describe the detection method of the side end position of the recording sheet P by the sheet end detection unit 40 and shows the positional relationship between the developed peripheral surface 27*b* of the conveying roller 27 and the recording sheet P for coming in contact with the peripheral surface 27*b* and a signal output from the first piezoelectric element band 42. As shown in FIGS. 7(*a*) and (*b*), the contact between the recording sheet P and the first piezoelectric element band 42 involves two modes; one is a mode in which the "leading end" of the recording sheet P initially comes in contact with the first piezoelectric element band 42 as shown in FIG. 7(*a*) and the other is a mode in which a "side end" of the recording sheet P initially comes in contact with the first piezoelectric element band 42 as shown in FIG. 7(*b*).

To begin with, the case shown in FIG. 7(*a*) will be discussed in detail. When the conveying roller 27 becomes phase $A_1$ at the first revolution, the recording sheet P is inserted into the nip between the conveying roller 27 and the driven roller 28 and at the same time, the leading end of the recording sheet P comes in contact with the first piezoelectric element band 42 and a signal from the first piezoelectric element band 42 makes an off (noncontact state) to on (contact state) transition. Then, at the time of the end of the first rotation of the conveying roller 27 (phase $2\pi$), the recording sheet P and the first piezoelectric element band 42 are once brought out of contact with each other (noncontact state) and thus the signal from the first piezoelectric element band 42 makes an on to off transition. Subsequently, when the conveying roller 27 becomes phase $A_2$ ($\leq A_1+2\pi$) at the second revolution, side end position $P_2$ of the recording sheet P comes in contact with the first piezoelectric element band 42 and the signal from the first piezoelectric element band 42 again makes an off to on transition. Therefore, in the contact mode shown in FIG. 7(*a*), when the signal from the first piezoelectric element band 42 makes a second off to on transition, the first piezoelectric element hand 42 and the side end of the recording sheet P come in contact with each other.

In the case shown in FIG. 7(*b*), when the conveying roller 27 becomes phase $A_3$ at the first revolution, side end position $P_3$ of the recording sheet P comes in contact with the first piezoelectric element band 42 and a signal from the first piezoelectric element band 42 makes an off to on transition.

Then, at the time of the end of the first rotation of the conveying roller 27 (phase $2\pi$), the recording sheet P and the first piezoelectric element band 42 are once brought out of contact with each other (noncontact state) and thus the signal from the first piezoelectric element band 42 makes an on to off transition. Subsequently, when the conveying roller 27 becomes phase $A_4$ ($\leq A_3+2\pi$) at the second revolution, side end position $P_4$ of the recording sheet P comes in contact with the first piezoelectric element band 42 and the signal from the first piezoelectric element band 42 again makes an off to on transition. Therefore, also in the contact mode shown in FIG. 7(*b*), when the signal from the first piezoelectric element band 42 makes a second off to on transition, the first piezoelectric element band 42 and the side end of the recording sheet P come in contact with each other.

Thus, in the sheet end detection unit 40 according to example 1, in both the contact modes in FIGS. 7(*a*) and 7 (*b*), when the signal from the first piezoelectric element band 42 makes a second off to on transition within $2\pi$in phase change of the conveying roller 27, the first piezoelectric element band 42 and the side end of the recording sheet P come in contact with each other. Therefore, the side end position of the recording sheet P can be acquired from the phase $A_2$, $A_4$ of the conveying roller 27 when the signal thus makes a transition.

Figure 8:
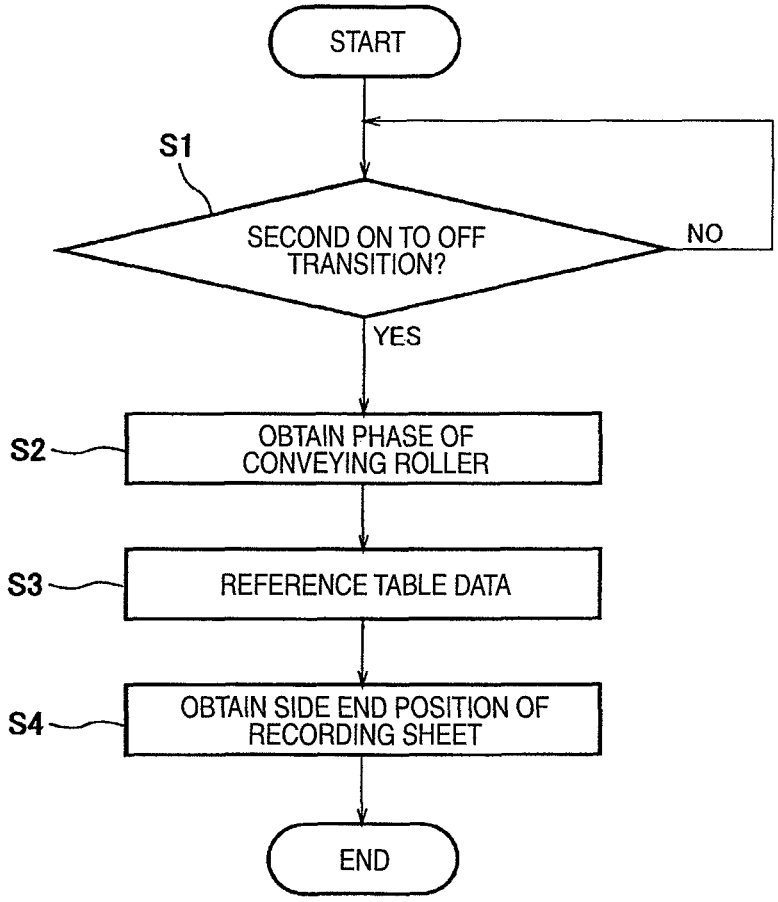
FIG. 8 is a flowchart to show the operation when the side end position of the recording sheet is detected using the sheet end detection unit shown in FIG. 3.

FIG. 8 is a flowchart to show the operation when the side end position of the recording sheet P is detected based on the above-described method using the sheet end detection unit 40. As shown in FIG. 8, the controller 50 determines whether or not the signal from the first piezoelectric element band 42 makes a second off to on transition within $2\pi$in phase change of the conveying roller 27 (S1. If the controller 50 does not determine at step 1 that the signal makes a second off to on transition within $2\pi$ (NO at S1), the controller 50 repeats the determination at step 1. If the controller 50 determines that the signal makes a second off to on transition within $2\pi$ (YES at S1), the controller 50 acquires the phase of the conveying roller 27 at the detecting time of the signal making the transition according to a signal from the encoder 41 (S2). The controller 50 references the table data 52*a* (FIG. 6) in the memory 52 (S3) and acquires information stored in association with the phase of the conveying roller 27 indicated by the signal acquired from the encoder 41, namely, information concerning the side end position of the recording sheet P (S4).

Thus, the sheet end detection unit 40 according to example 1 can detect the side end position of the recording sheet P. As for the detection accuracy, the side end position is detected based on the phase of the conveying roller 27 at the contact time between the first piezoelectric element band 42 and the recording sheet P, so that the side end position can be detected with very high accuracy as compared with the related arts.

There is a possibility that the signal may make a second off to on transition at the second revolution of the conveying roller 27 since the conveying roller 27 and the recording sheet P started to come in contact with each other as shown in FIG. 7. However, the conveying direction dimension $L_2$ of the recording sheet P is twice the outer peripheral dimension $L_1$ of the conveying roller 27 or more as previously described and thus the recording sheet P and the first piezoelectric element band 42 reliably come in contact with each other even at the second revolution and no problem arises.

It is desirable that a plurality of recording sheets P conveyed consecutively on the conveying passage 23 should be conveyed with a spacing of the outer peripheral dimension $L_1$ of the conveying roller 27 or more from each other. In so doing, after completion of detection of the side end position about the first recording sheet P, it is confirmed that a signal indicating change in the contact state is not input from the first piezoelectric element band 42 during one revolution of the conveying roller 27, whereby it can be determined that the first recording sheet P has passed through the conveying roller pair 29. Therefore, then, if a signal indicating change in the contact state from the first piezoelectric element band 42 is detected, the signal is assumed to be the signal first making an off to on transition (signal occurring in phase $A_1$, $A_3$ in FIG. 7), and detection of the side end position of the second recording sheet P can be started. This point also applies to the following examples.

EXAMPLE 2

Figure 9:
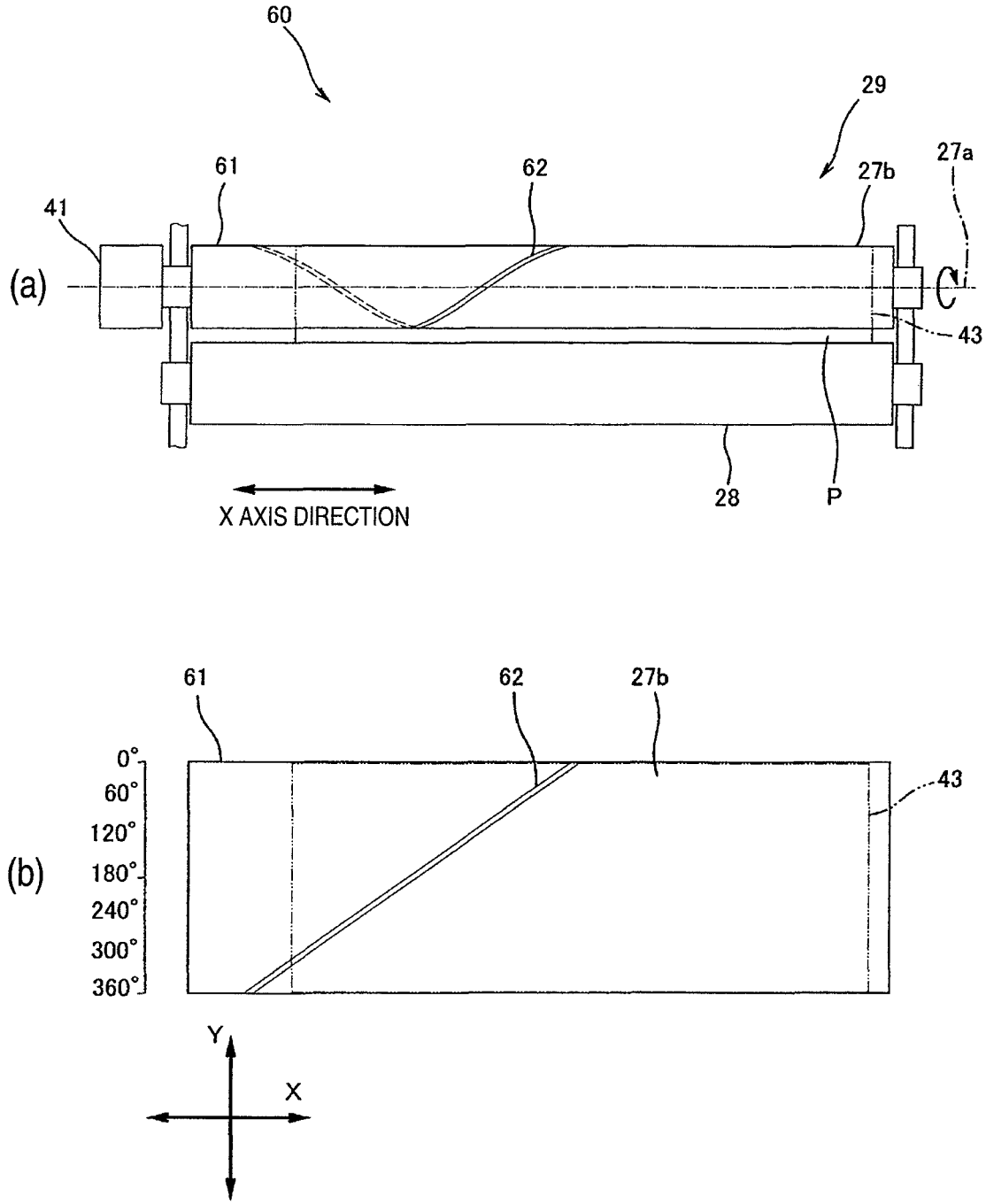
FIG. 9 is a drawing to show a sheet end detection unit having another configuration.

FIG. 9 is a drawing to show a sheet end detection unit 60 having another configuration; FIG. 9(*a*) is a front view and 9(*b*) is a drawing of developing the peripheral surface of a conveying roller 61 that the sheet end detection unit 60 has. The sheet end detection unit 60 shown in FIG. 9 differs from the sheet end detection unit 40 described above only in that it has a first piezoelectric element band 62 provided in a different manner from the first piezoelectric element band 42 that the sheet end detection unit 40 shown in FIG. 3 has.

Therefore, only the first piezoelectric element band 62 will be discussed and components identical with or similar to those of the sheet end detection unit 40 previously described with reference to the accompanying drawings are denoted by the same reference numerals and will not be discussed again.

As shown in the developed view of FIG. 9(*b*), the first piezoelectric element band 62 according to example 2 is formed so that a position on the first piezoelectric element band 62 opposed to the conveying passage 23 makes a transition from an inner portion of a contact area 43 to an outer portion with rotation of the conveying roller 27. In other words, as the phase detected by the encoder 41 becomes larger, the first piezoelectric element band 62 extends from the inner portion of the contact area 43 toward an opposite side in the direction of an axis 27*a* to the outer portion of the contact area 43. Therefore, the first piezoelectric element band 62 is provided so as to become spiral making a round in the opposite direction to the first piezoelectric element band 42 shown in FIG. 3.

Figure 10:
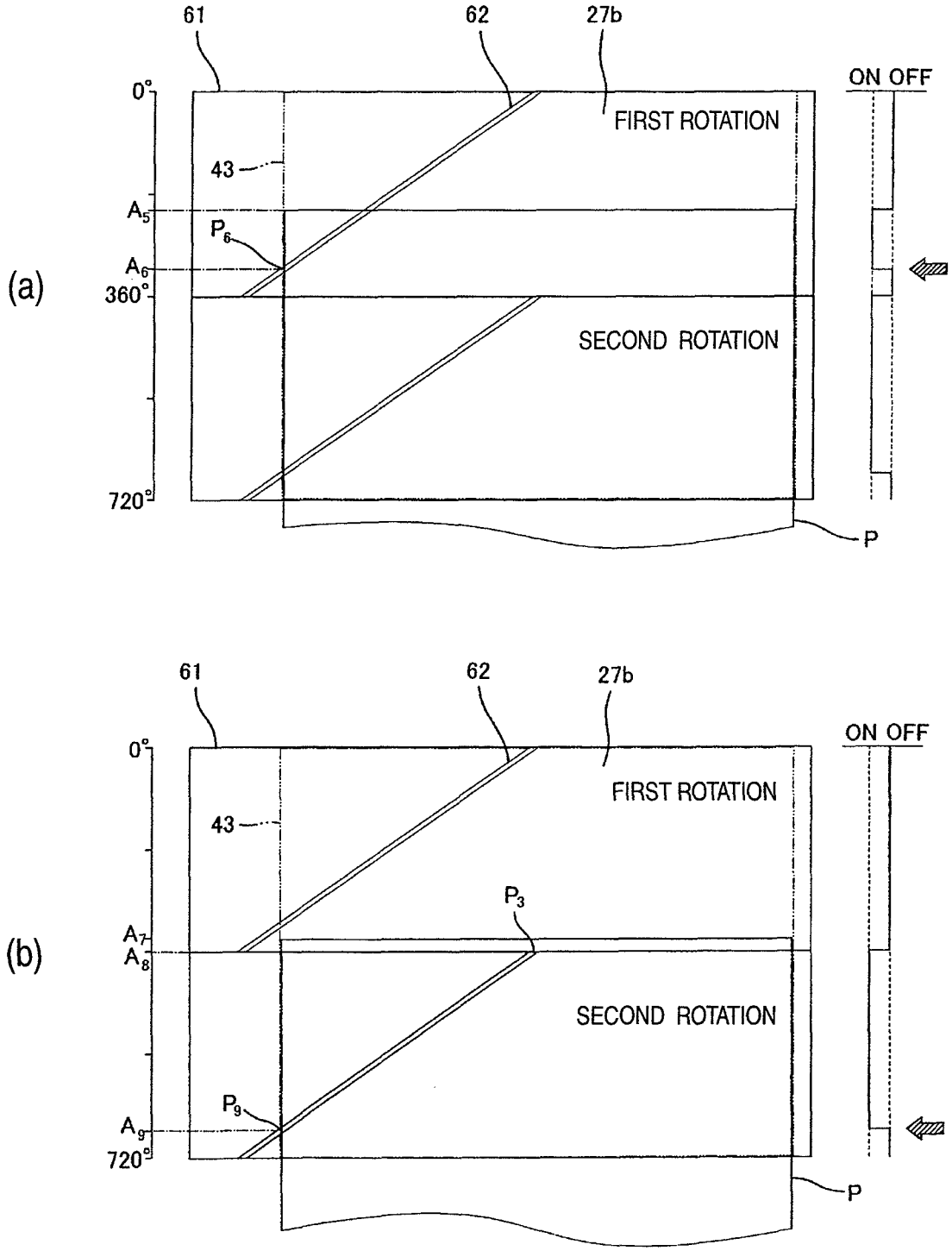
FIG. 10 is a drawing to describe a detection method of a side end position of a recording sheet by a sheet end detection unit according to example 2 and shows the positional relationship between a developed peripheral surface of a conveying roller 61 and the recording sheet for coming in contact with the peripheral surface and a signal output from a first piezoelectric element band.

FIG. 10 is a drawing to describe the detection method of the side end position of the recording sheet P by the sheet end detection unit 60 according to example 2 and shows the positional relationship between a developed peripheral surface 27*b* of the conveying roller 61 and the recording sheet P for coming in contact with the peripheral surface 27*b* and a signal output from the first piezoelectric element band 62. As shown in FIGS. 10(*a*) and (*b*), the contact between the recording sheet P and the first piezoelectric element band 62 involves two modes; one is a mode in which the "leading end" of the recording sheet P initially comes in contact with the first piezoelectric element band 62 as shown in FIG. 10(*a*) and the other is a mode in which a "side end" of the recording sheet P initially comes in contact with the first piezoelectric element band 62 as shown in FIG. 10(*b*).

To begin with, the case shown in FIG. 10(*a*) will be discussed in detail. When the conveying roller 61 becomes phase $A_5$ at the first revolution, the recording sheet P is inserted into the nip between the conveying roller 61 and a driven roller 28 and at the same time, the leading end of the recording sheet P comes in contact with the first piezoelectric element band 62 and a signal from the first piezoelectric element band 62 makes an off (noncontact state) to on (contact state) transition. Subsequently, when the conveying roller 61 becomes phase $A_6$, side end position $P_6$ of the recording sheet P comes in contact with the first piezoelectric element band 62 and the signal from the first piezoelectric element band 62 makes an on to off transition. Therefore, in the contact mode shown in FIG. 10(*a*), when the signal from the first piezoelectric element band 62 makes an on to off transition (namely, initially makes an on to off transition) after the signal once makes an off to on transition, the first piezoelectric element band 62 and the side end of the recording sheet P come in contact with each other.

In the case shown in FIG. 10(*b*), when the conveying roller 61 becomes phase $A_7$ at the first revolution, the recording sheet P comes in contact with the peripheral surface of the conveying roller 61; at this point in time, however, the first piezoelectric element band 62 and the recording sheet P do not come in contact with each other and thus change in the contact state does not occur in the signal from the first piezoelectric element band 62. Then, when the conveying roller 61 becomes phase $A_8$, an inner position $P_8$ of the recording sheet P comes in contact with the first piezoelectric element band 62 and the signal from the first piezoelectric element band 62 makes an off to on transition. Subsequently, when the conveying roller 61 becomes phase $A_9$ at the second revolution, side end position $P_9$ of the recording sheet P comes in contact with the first piezoelectric element band 62 and the signal from the first piezoelectric element band 62 makes an on to off transition. Therefore, also in the contact mode shown in FIG. 10(*b*), when the signal from the first piezoelectric element band 62 makes an on to off transition (namely, initially makes an on to off transition) after the signal once makes an off to on transition, the first piezoelectric element band 62 and the side end of the recording sheet P come in contact with each other.

Thus, in the sheet end detection unit 60 according to example 2, in both the contact modes in FIGS. 10(*a*) and 10(*b*), when the signal from the first piezoelectric element band 62 initially makes an off to on transition, the first piezoelectric element band 62 and the side end of the recording sheet P come in contact with each other. Therefore, the side end position of the recording sheet P can be acquired from the phase $A_6$, $A_9$ of the conveying roller 61 when the signal thus makes a transition.

Figure 11:
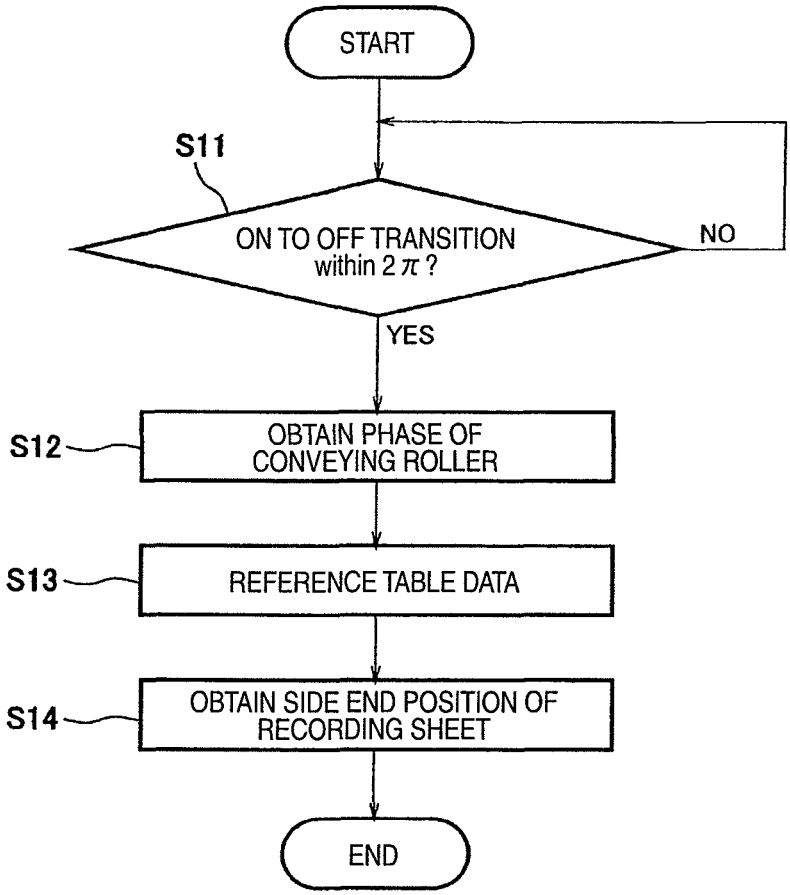
FIG. 11 is a flowchart to show the operation when the side end position of the recording sheet is detected using the sheet end detection unit shown in FIG. 10.

FIG. 11 is a flowchart to show the operation when the side end position of the recording sheet P is detected based on the above-described method using the sheet end detection unit 60. As shown in FIG. 11, the controller 50 determines whether or not the signal from the first piezoelectric element band 62 makes an off to on transition within 2πin phase change of the conveying roller 61 (S11). If the controller 50 does not determine at step 11 that the signal makes an off to on transition within 2π (NO at S11), the controller 50 repeats the determination at step 11. If the controller 50 determines that the signal makes an off to on transition within 2π (YES at S11), the controller 50 acquires the phase of the conveying roller 61 at the detecting time of the signal making the transition according to a signal from the encoder 41 (S12). The controller 50 references the table data 52*a* (FIG. 6) in the memory 52 (S13) and acquires information stored in association with the phase of the conveying roller 61 indicated by the signal acquired from the encoder 41, namely, information concerning the side end position of the recording sheet P (S14).

Thus, the sheet end detection unit 60 according to example 2 can also detect the side end position of the recording sheet P. As for the detection accuracy, the side end position is detected based on the phase of the conveying roller 61 at the contact time between the first piezoelectric element band 62 and the recording sheet P, so that the side end position can be detected with very high accuracy as compared with the related arts, as with the configuration of example 1.

EXAMPLE 3

Figure 12:
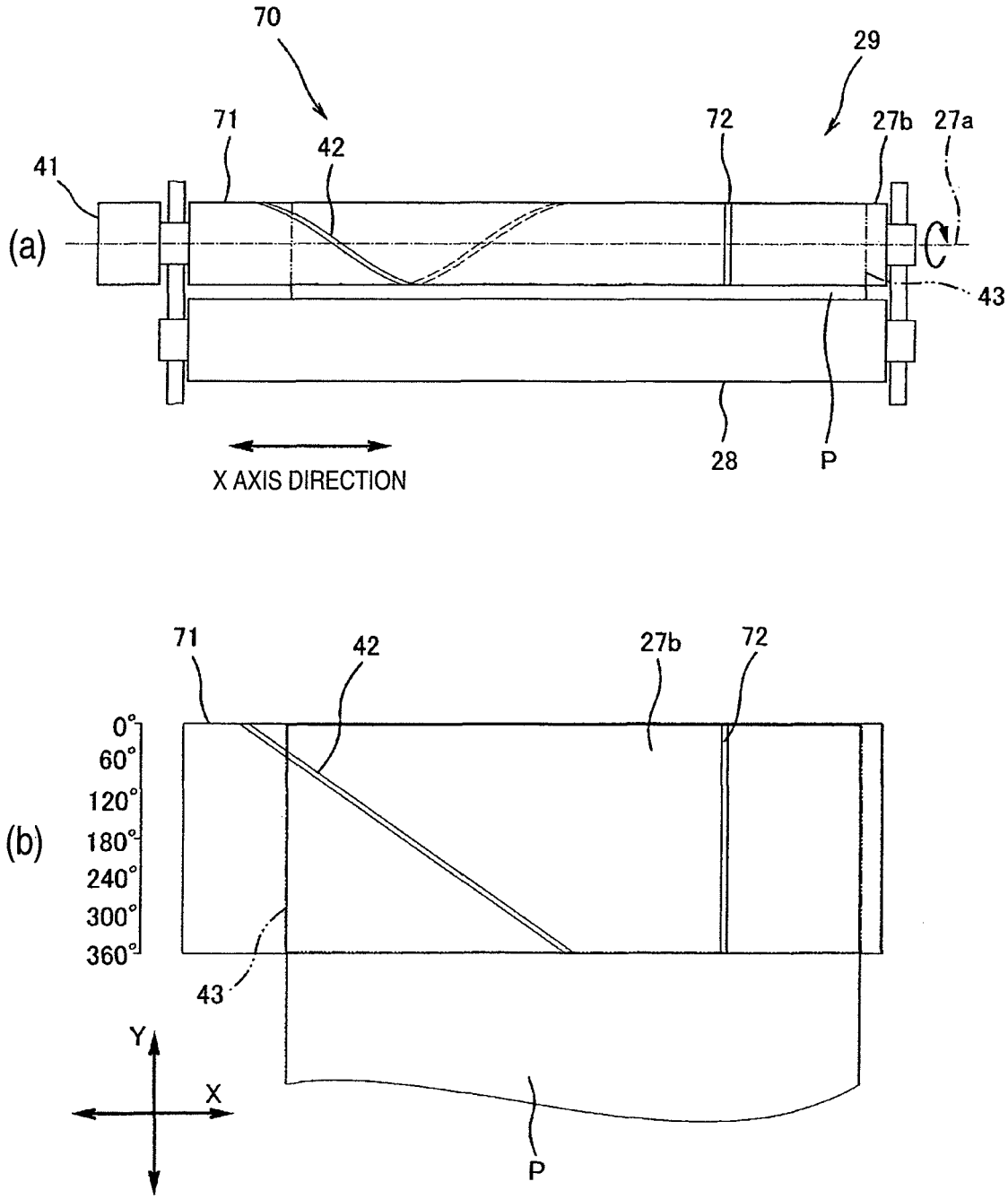
FIG. 12 is a drawing to show a sheet end detection unit having another configuration.

FIG. 12 is a drawing to show a sheet end detection unit 70 having another configuration; FIG. 12(*a*) is a front view and 12(*b*) is a drawing of developing the peripheral surface of a conveying roller 71 that the sheet end detection unit 70 has. The sheet end detection unit 70 shown in FIG. 12 differs from the sheet end detection unit 40 described above only in that it includes a second piezoelectric element band 72 in addition to the first piezoelectric element band 42 that the sheet end detection unit 40 of example 1 shown in FIG. 3 has. Therefore, only the second piezoelectric element band 72 will be discussed and components identical with or similar to those of the sheet end detection unit 40 previously described with reference to the accompanying drawings are denoted by the same reference numerals and will not be discussed again.

As shown in FIG. 12, the second piezoelectric element band 72 is shaped like a band and is provided so as to make a round around the axis 27*a* of the conveying roller 71 in the contact area 43. The cross-sectional shape of the second piezoelectric element band 72 and the proximity thereof is similar to that of the first piezoelectric element band 42 and the proximity thereof shown in FIG. 5, and the second piezoelectric element band 72 also includes piezoelectric elements. The second piezoelectric element band 72 can detect the leading end position of a recording sheet P because it comes in contact the recording sheet P at the same time as the recording sheet P conveyed along the conveying passage 23 is inserted into the nip between the conveying roller 71 and the driven roller 28.

Thus, the sheet end detection unit 70 including the second piezoelectric element band 72 in addition to the first piezoelectric element band 42 can detect not only the side end position of the recording sheet P according to the first piezoelectric element band 42, but also the leading end position of the recording sheet P according to the second piezoelectric element band 72. Therefore, the four corner positions of a general recording sheet P shaped like a rectangle on a plan view can be detected precisely.

Figure 13:
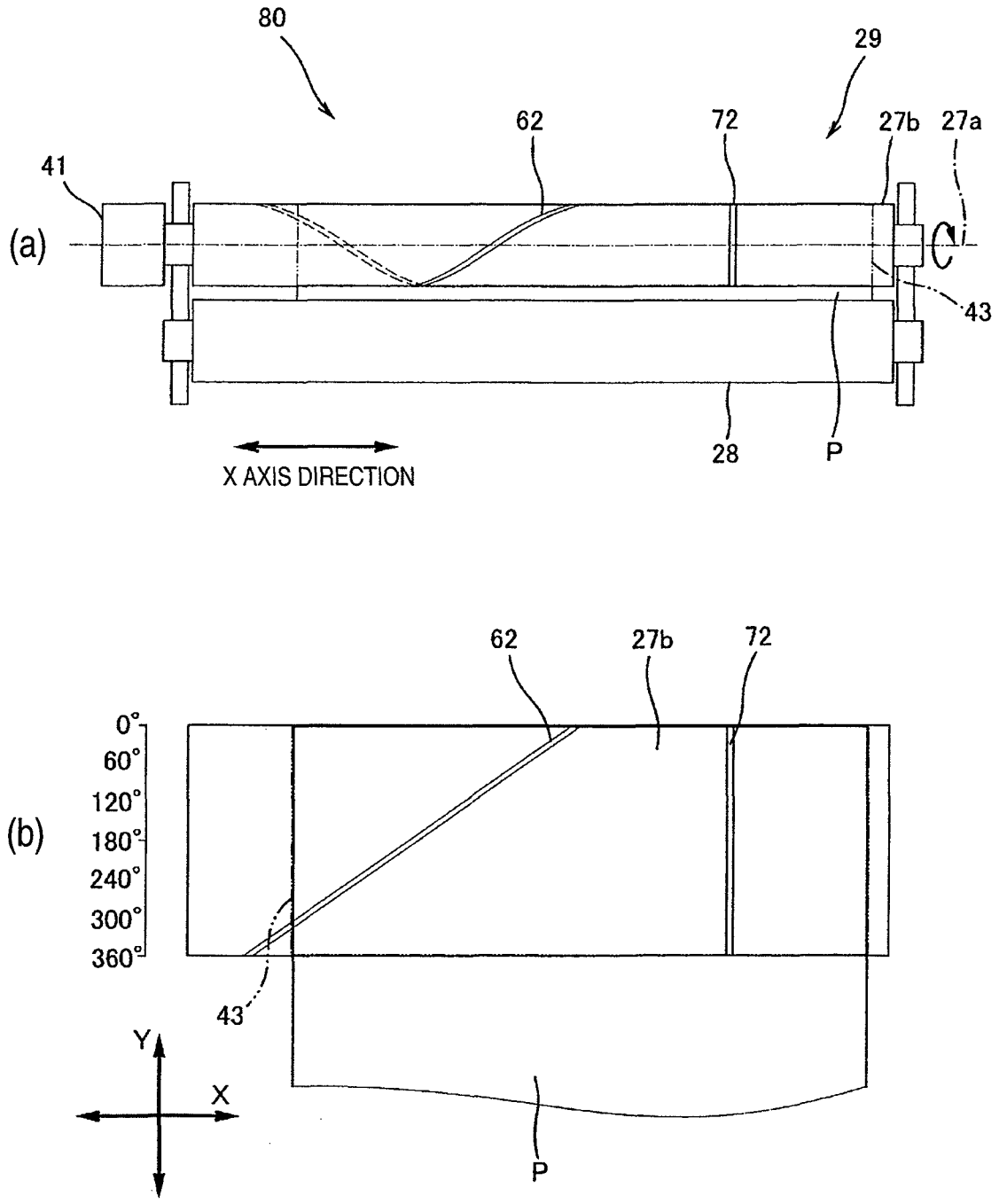
FIG. 13 is a drawing to show a sheet end detection unit having another configuration.

In FIG. 12, the configuration of adding the second piezoelectric element band 72 for detecting the leading end position of the recording sheet P to the sheet end detection unit 40 shown in example 1 is described, but the second piezoelectric element band 72 may be added to the sheet end detection unit 60 (see FIG. 9) shown in example 2, as shown in FIG. 13. In so doing, a sheet end detection unit 80 shown in FIG. 13 can detect not only the side end position of the recording sheet P according to the first piezoelectric element band 62, but also the leading end position of the recording sheet P according to the second piezoelectric element band 72.

EXAMPLE 4

Figure 14:
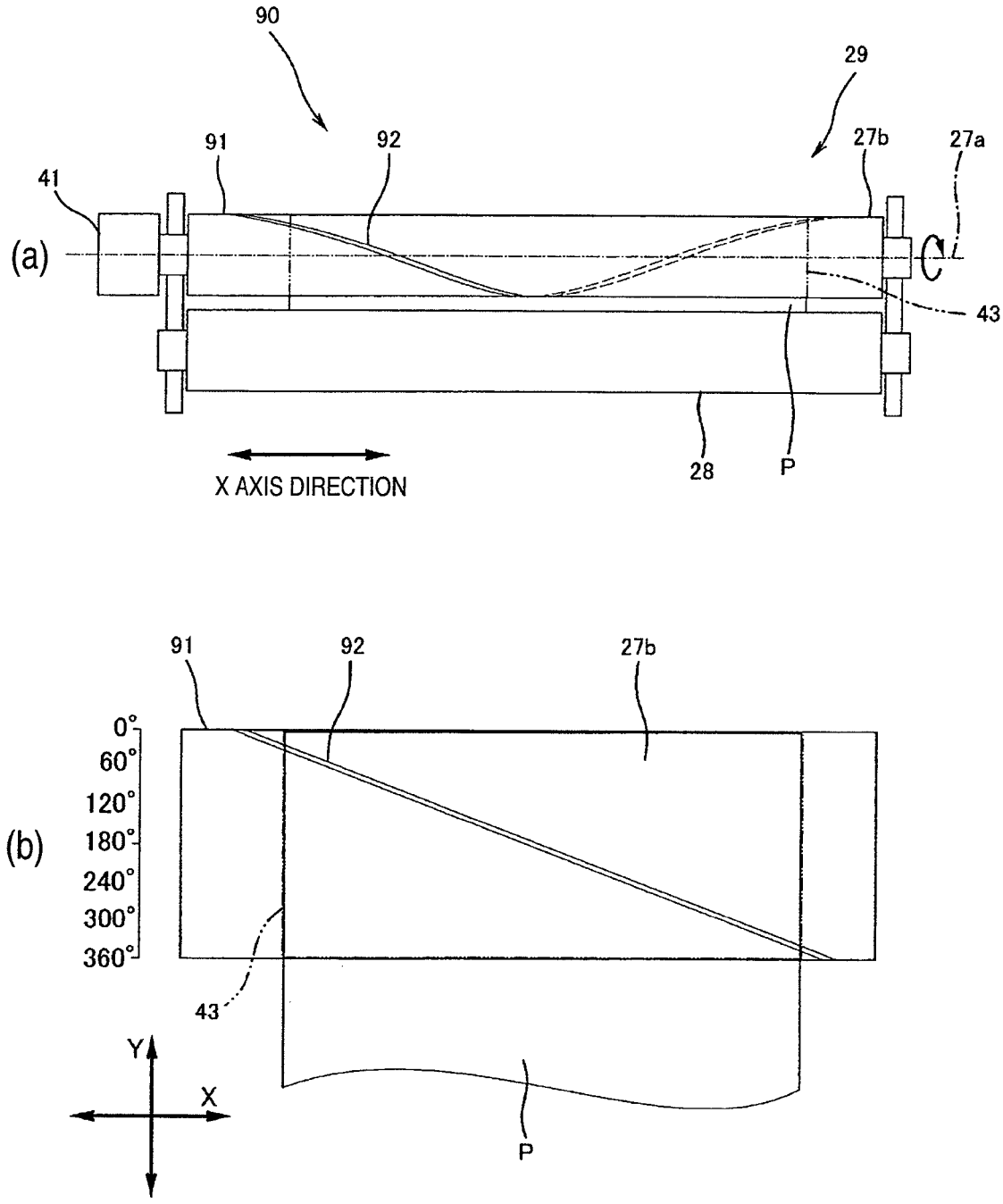
FIG. 14 is a drawing to show a sheet end detection unit having another configuration.

FIG. 14 is a drawing to show a sheet end detection unit 90 having another configuration; FIG. 14(*a*) is a front view and 14(*b*) is a drawing of developing the peripheral surface of a conveying roller 91 that the sheet end detection unit 90 has. The sheet end detection unit 90 shown in FIG. 14 differs from the sheet end detection unit 40 described above only in that it has a first piezoelectric element band 92 provided in a different manner from the first piezoelectric element band 42 that the sheet end detection unit 40 shown in FIG. 3 has. Therefore, only the first piezoelectric element band 92 will be discussed and components identical with or similar to those of the sheet end detection unit 40 previously described with reference to the accompanying drawings are denoted by the same reference numerals and will not be discussed again.

As shown in FIG. 14, the first piezoelectric element band 92 shown in example 4 is formed so that it extends linearly and a position on the first piezoelectric element band 92 opposed to the conveying passage 23 makes a transition from an outer portion of a contact area 43 to an inner portion with rotation of the conveying roller 91 like the first piezoelectric element band 42 previously described and further extends and again makes a transition from the inner portion to the outer portion. In other words, as the phase detected by the encoder 41 becomes larger, the first piezoelectric element band 92 extends from the outer portion of the contact area 43 toward one side in the direction of an axis 27*a* to the inner portion of the contact area 43 and further extends so as to reach the outer portion of the contact area 43, as shown in FIG. 14(*b*).

Figure 15:
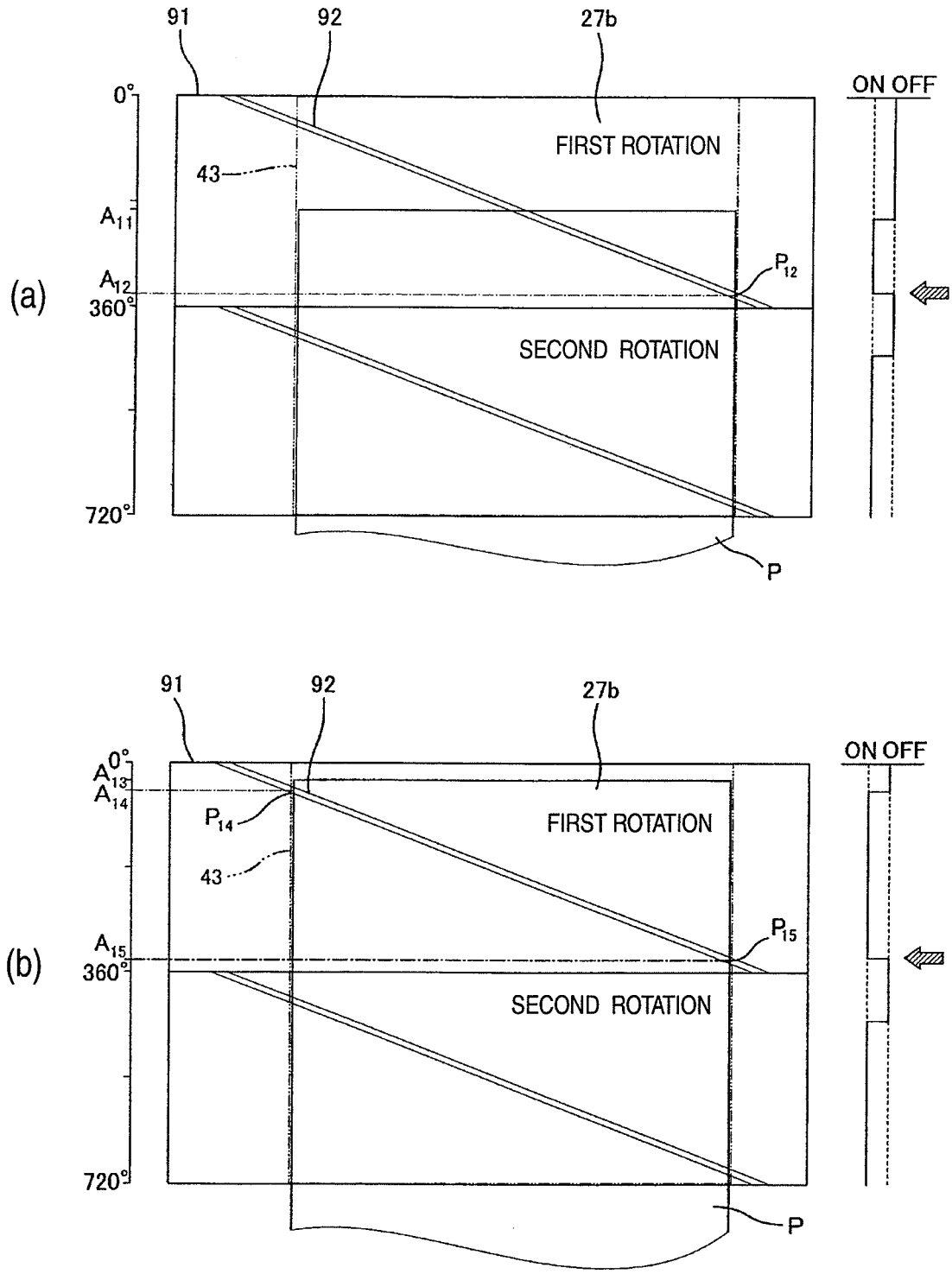
FIG. 15 is a drawing to describe a detection method of a side end position of a recording sheet by the sheet end detection unit shown in FIG. 14 and shows the positional relationship between the developed peripheral surface of the conveying roller and a recording sheet for coming in contact with the peripheral surface and a signal output from the first piezoelectric element band.

FIG. 15 is a drawing to describe the detection method of the side end position of a recording sheet P by the sheet end detection unit 90 according to example 2 and shows the positional relationship between a developed peripheral surface 27*b* of the conveying roller 91 and the recording sheet P for coming in contact with the peripheral surface 27*b* and a signal output from the first piezoelectric element band 92. As shown in FIGS. 15(*a*) and (*b*), the contact between the recording sheet P and the first piezoelectric element band 92 involves two modes; one is a mode in which the "leading end" of the recording sheet P initially comes in contact with the first piezoelectric element band 92 as shown in FIG. 15(*a*) and the other is a mode in which a "side end" of the recording sheet P initially comes in contact with the first piezoelectric element band 92 as shown in FIG. 15(*b*).

To begin with, the case shown in FIG. 15(*a*) will be discussed in detail. When the conveying roller 91 becomes phase $A_{11}$ at the first revolution, the recording sheet P is inserted into the nip between the conveying roller 91 and a driven roller 28 and at the same time, the leading end of the recording sheet P comes in contact with the first piezoelectric element band 92 and a signal from the first piezoelectric element band 92 makes an off (noncontact state) to on (contact state) transition. Subsequently, when the conveying roller 91 becomes phase $A_{12}$, side end position $P_{12}$ of the recording sheet P comes in contact with the first piezoelectric element band 92 and the signal from the first piezoelectric element band 92 makes an on to off transition. Therefore, in the contact mode shown in FIG. 15(*a*), when the signal from the first piezoelectric element band 92 makes an on to off transition (namely, initially makes an on to off transition) after the signal once makes an off to on transition, the first piezoelectric element band 92 and the side end of the recording sheet P come in contact with each other.

In the case shown in FIG. 15(*b*), when the conveying roller 91 becomes phase $A_{13}$ at the first revolution, the recording sheet P comes in contact with the peripheral surface of the conveying roller 91; at this point in time, however, the first piezoelectric element band 92 and the recording sheet P do not come in contact with each other and thus change in the contact state does not occur in the signal from the first piezoelectric element band 92. Then, when the conveying roller 91 becomes phase $A_{14}$, one side end position $P_{14}$ of the recording sheet P comes in contact with the first piezoelectric element band 92 and the signal from the first piezoelectric element band 92 makes an off to on transition. Subsequently, when the conveying roller 91 becomes phase $A_{15}$ at the second revolution, opposite side end position $P_{15}$ of the recording sheet P comes in contact with the first piezoelectric element band 92 and the signal from the first piezoelectric element band 92 makes an on to off transition. Therefore, also in the contact mode shown in FIG. 15(*b*), when the signal from the first piezoelectric element band 92 makes an on to off transition (namely, initially makes an on to off transition) after the signal once makes an off to on transition, the first piezoelectric element band 92 and the side end of the recording sheet P come in contact with each other.

Thus, in the sheet end detection unit 90 according to example 4, in both the contact modes in FIGS. 15(*a*) and 15(*b*), when the signal from the first piezoelectric element band 92 initially makes an off to on transition, the first piezoelectric element band 92 and the side end of the recording sheet P come in contact with each other. Therefore, the side end position of the recording sheet P can be acquired from the phase $A_{12}$, $A_{15}$ of the conveyinq roller 91 when the signal thus makes a transition.

The mode in which the signal from the first piezoelectric element band 92 initially makes an off to on transition, the first piezoelectric element band 92 and the side end of the recording sheet P come in contact with each other is similar to that of the sheet end detection unit 60 in example 2. Therefore, the operation of the controller 50 based on the method described above using the sheet end detection unit 90 according to example 4 is similar to the operation previously described with reference to the flowchart of FIG. 11.

In the above-described example 1 to 4, one first piezoelectric element band is provided on the peripheral surface 27*b* of the roller 27. However, as shown in FIGS. 16 and 17, a plurality of first piezoelectric element bands may be provided on the peripheral surface 27*b* of the roller 27.

Figure 16:
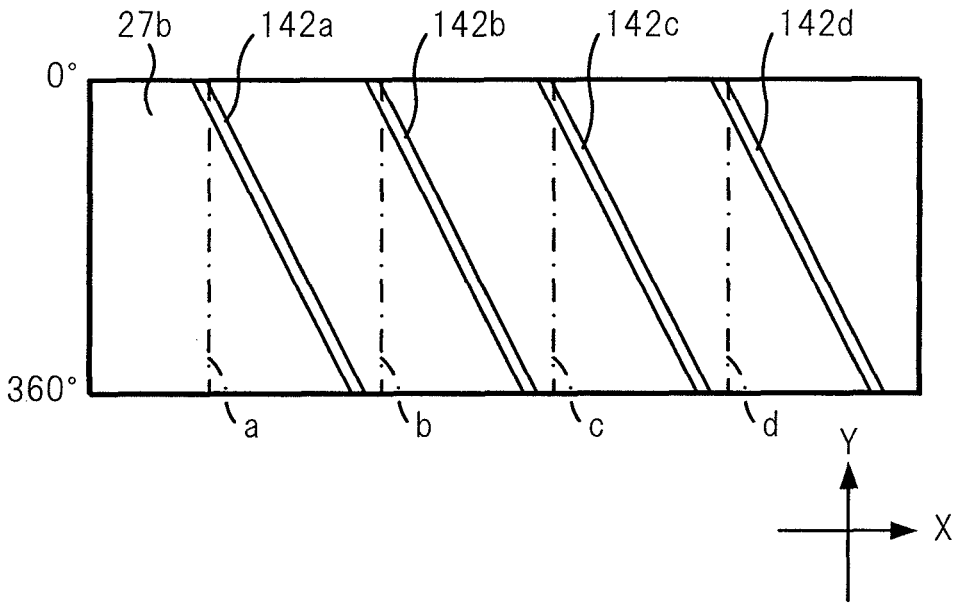
FIG. 16 shows a development view of a peripheral surface of the conveying roller of a still another embodiment.
Figure 17:
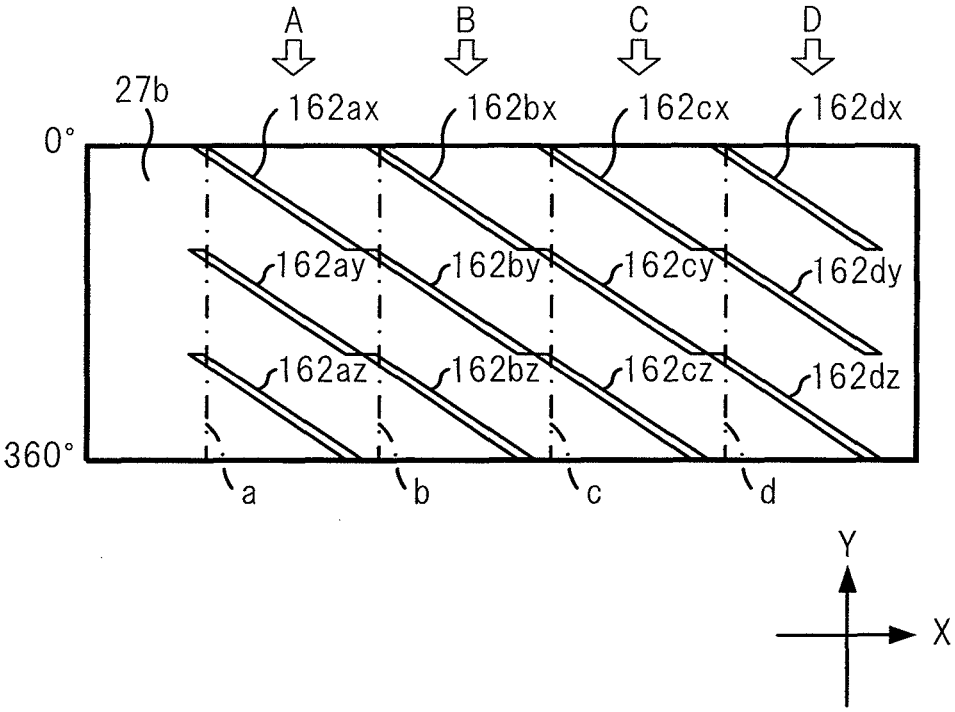
FIG. 17 shows a development view of a peripheral surface of the conveying roller of a still another embodiment.

In the example shown in FIG. 16, first piezoelectric element hands 142*a*, 142*b*, 142*c* and 142*d* are provided on the peripheral surface 27*b* of the roller 27 and arranged along the X-axis direction (i.e., the axial direction of the roller 27). Further, the first piezoelectric element bands 142*a* to 142*d* are separated one another. In other words, the first piezoelectric element bands 142*a* to 142*d* output the signals independently.

The range of each of the first piezoelectric element bands 142*a* to 142*d* in the X-axis direction may be set according to the size of the recording sheet to be conveyed. In this case, the first piezoelectric element bands 142*a* to 142*d* are provided for detecting the end positions of the recording sheets of first to fourth sizes, respectively. For example, the first piezoelectric element band 142*a* is provided for detecting the end position of the recording sheet of A4 size, and the first piezoelectric element band 142*b* is provided for detecting the end position of the recording sheet of B5 size. In other words, the first piezoelectric element bands 142*a* to 142*d* are provided on the peripheral surface inside and outside the contact area to the recording sheets of respective sizes. One example of the end positions of the recording sheets of the respective sizes is shown by chain lines "a" to "d."

The method for detecting the end position of the recording sheet using each of the piezoelectric element bands 142*a* to 142*d* are similar to the above-described examples. Further, when the size of the recording sheet to be conveyed is designated by the operation panel 11, only one of the piezoelectric element bands 142*a* to 142*d* corresponding to the designated size may be used for detecting the end position of the recording sheet. For example, if A4 size is designated, the controller 50 may detect the end position of the recording sheet based on only the output from the piezoelectric element band 142*a*. On the other hand, the controller 50 may detect the end position of the recording sheet based on the combination of the signals output from the piezoelectric element bands 142*a* to 142*d*. For example, when the controller 50 detects the ON signals output from the piezoelectric element bands 142*b* to 142*d* and does not detect the ON signal from the piezoelectric element bands 142*a*, the controller 50 determines the recording sheet is B5 size and detects the end position by using the signal output from the piezoelectric element band 142*b*.

FIG. 17 shows a still another example of the arrangement of the first piezoelectric element band. As shown in FIG. 17, the plurality of the first piezoelectric element bands may be provided in the Y-axis direction, in addition to the X-direction. In this example, four groups "A" to "D" of the first piezoelectric element bands are provided along the X-axis direction, and three first piezoelectric element bands are provided in the Y-axis direction for each of the groups of the first piezoelectric element bands. The first piezoelectric-element bands 162*ax* to 162*az*, 162*bx* to 162*bz*, 162*cx* to 162*cz*, 162*dx* to 162*dz* are separately provided. The first piezoelectric element bands in the same group do not overlap one another in the Y-axis direction but continuously provided in the Y-axis direction. The controller 50 detects the end position using the first piezoelectric element bands arranged in the Y-axis direction (i.e., the first piezoelectric element bands in a same group) for the corresponding size of the recording sheet. In the above-described examples, the end position can be detected during two rotations of the roller 27 (i.e., 720° in phase) at maximum. In contrast, according to this arrangement, the end position can be detected during a rotation of the roller 27 up to 240° in phase.

Although the example of FIG. 17 shows plural first piezoelectric element bands are provided along the X-axis and Y-axis directions, a plurality of the first piezoelectric element bands is arranged only in the Y-axis direction (that is, only one first piezoelectric element band is arranged in the X-axis direction).

By the way, in examples 1 to 4 described above, the sheet end detection unit 40, 60, 70, 80, 90 provided in the printer unit 2, namely, the sheet end detection unit 40, etc., for detecting the position of a recording sheet when the image recording apparatus 1 executes the printer function, the copy function, or the facsimile function has been described, but can also be adopted for detecting the position of a sheet fed in a scanner having an automatic sheet feed function.

The first piezoelectric element band 42, 62, 92 need not be linear as shown in the developed view and may be any other form if the position in the direction along the axis 27*a* of the conveying roller 27, etc., and the phase around the axis 27*a* are in a one-to-one correspondence with each other about an arbitrary point in the extension direction of the first piezoelectric element band 42, etc. Further, the positions of the start point and the end point of the second piezoelectric element band 72, 82 as shown in FIGS. 12 and 13 in the direction along the axis 27*a* need not match; for example, it may be provided like a spiral around the axis 27*a* if it extends in the contract area 43 of the peripheral surface 27*b*.

In the examples described above, the first piezoelectric element band 42, 62, 72, 82, 92 including piezoelectric elements has been described, but the invention is not limited to the mode. For example, a pressure sensitive capacity change material involving correlation between given pressure and output potential can also be used even if it is a material different from piezoelectric elements. As the material, for example, a pressure sensitive material manufactured by EMFIT with a large number of air bubbles formed in a resin of polypropylene (PP), etc., can be adopted. If the material is formed of a film and the film is pressurized from both faces, a charge move occurs in the material and a potential difference occurs between both the faces. Thus, change in the potential difference is detected, whereby an end part of a recording sheet P can be detected.

As a material capable of detecting pressure change on a different principle from piezoelectric elements, a pressure sensitive conductive material involving correlation between given pressure and conductivity (resistance value) can also be used. As the material, a material called inustomer (registered trademark) with conductive particles dispersed and mixed into an insulating polymer can be adopted. If the material is formed of a film and the film is pressurized from both faces, the conductive particles in the material come in contact with or are brought close to each other, whereby the electric resistance value between both the faces lowers. Thus, change in the electric resistance value is detected, whereby an end part of a recording sheet P can be detected.

Each piezoelectric element adopted in the embodiment has high rigidity as compared with the pressure sensitive material manufactured by EMFIT and inustomer (trade name) and thus has the advantage that when it comes in contact with a recording sheet P, deformation of the element is small and the influence on conveying the recording sheet P is small.

The invention can be applied to a sheet end detection device that can be easily manufactured and can suppress the manufacturing cost while detecting the end position (particularly, side end position) of a conveyed sheet such as a recording sheet, an image recording apparatus including the sheet end detection device, and an end position detection method of a recording sheet using the sheet end detection device.

In the above embodiment, a sheet end detection device includes a cylindrical roller being provided at a midpoint in a conveying passage of a conveyed sheet and capable of rotating around an axis with conveying of the conveyed sheet in a state in which a peripheral surface comes in contact with one face of the conveyed sheet and a phase detection unit for detecting a phase around the axis of the roller, wherein the roller is provided on the peripheral surface with a first piezoelectric element band shaped like a band for detecting contact with the conveyed sheet so as to make a round around the axis while extending in the axial center direction over the inside and the outside of a contact area with the conveyed sheet on the peripheral surface, and wherein the first piezoelectric element band is formed so that the axis direction position of the roller at an arbitrary point in the extension direction of the first piezoelectric element band and the phase around the axis of the roller are in a one-to-one correspondence with each other.

In an end position detection method of a conveyed sheet according to the embodiment using the sheet end detection device, based on the phase of the roller indicated by the phase detection unit when the first piezoelectric element band detects change in a contact state with the conveyed sheet, the axis direction position of the roller is acquired about the change position of the contact state with the conveyed sheet, thereby detecting the end position in a direction orthogonal to the conveying direction of the conveyed sheet.

With the sheet end detection device as described above, to detect contact with the conveyed sheet, the first piezoelectric element band shaped like a band is provided on the peripheral surface of the roller for rotating with conveying of the conveyed sheet, so that it is not necessary to provide a considerable number of piezoelectric elements and the sheet end detection device can be easily manufactured and the manufacturing cost can also be suppressed. The end part in the direction orthogonal to the conveying direction of the conveyed sheet (side end) can also be detected with high accuracy.

That is, according to the end position detection method of a conveyed sheet using the sheet end detection device described above, the contact position with the conveyed sheet in the first piezoelectric element band, more particularly, the axis direction position of the roller can be detected, so that the side end position of the conveyed sheet can be detected. The first piezoelectric element band can detect change in the contact state with the end part of the conveyed sheet (change from contact state to noncontact state and change from noncontact state to contact state) with good accuracy and thus the side end position of the conveyed sheet can also be detected with good accuracy.

The first piezoelectric element band may be provided so as to make only one round around the axis of the roller like a spiral along the peripheral surface of the roller. According to the configuration, the appearance of the first piezoelectric element band becomes geometrically simple and thus it becomes easier to manufacture the first piezoelectric element (band sheet end detection device). The angle between the extension direction of the first piezoelectric element and the side end of the conveyed sheet, namely, the angle between the direction in which the first piezoelectric element extends when the peripheral surface of the roller is developed and the direction in which the side end of the conveyed sheet extends has an influence on the detection accuracy of the side end of the conveyed sheet. In contrast, as for the first piezoelectric element band provided like a spiral, the extension direction of the first piezoelectric element is roughly the same at any position in the axis direction of the roller. Therefore, the angle between the extension direction of the side end of any of various conveyed sheets different in size and the extension direction of the first piezoelectric element becomes roughly uniform, so that variation in the detection accuracy caused by the size difference of the conveyed sheet is suppressed and the side end position can be detected with stable accuracy.

The first piezoelectric element band may be formed so that a position opposed to the conveying passage of the conveyed sheet makes a transition from an outer portion of the contact area to an inner portion with rotation of the roller. According to the configuration, the first piezoelectric element band detects change from the noncontact state to the contact state with the conveyed sheet, whereby the side end position of the conveyed sheet can be detected.

The first piezoelectric element band may be formed so that a position opposed to the conveying passage of the conveyed sheet makes a transition from an inner portion of the contact area to an outer portion with rotation of the roller. According to the configuration, the first piezoelectric element band detects change from the contact state with the conveyed sheet to the noncontact state, whereby the side end position of the conveyed sheet can be detected.

The roller may have an outer peripheral dimension being a half or less of a conveying direction dimension of the conveyed sheet. According to the configuration, while the roller makes one revolution while the conveyed sheet is being conveyed in a state in which the roller and the conveyed sheet are in contact with each other, if the side end of the conveyed sheet does not come in contact with the first piezoelectric element band on the peripheral surface of the roller, the first piezoelectric element band and the side end of the conveyed sheet will come in contact with each other at the second revolution of the roller and thus the side end of the conveyed sheet can be detected reliably.

The first piezoelectric element band may be formed so that a position opposed to the conveying passage of the conveyed sheet makes a transition from an outer portion of the contact area to an inner portion and further to the outer portion with rotation of the roller. According to the configuration, the first piezoelectric element band detects change from the noncontact state to the contact state with the conveyed sheet or change from the contact state with the conveyed sheet to the noncontact state, whereby the side end position of the conveyed sheet can be detected.

The roller may have an outer peripheral dimension equal to or less than a conveying direction dimension of the conveyed sheet. According to the configuration, the first piezoelectric element band and the side end of the conveyed sheet reliably come in contact with each other during one revolution of the roller and the side end of the conveyed sheet can be detected.

The peripheral surface of the roller may contain metal and comes in contact with the back of the first piezoelectric element band to form one electrode and on the surface of the first piezoelectric element band, an opposite electrode is extended along the first piezoelectric element band. According to the configuration, the peripheral surface of the roller can be used as one electrode and one electrode need not be formed additionally.

An insulating cover may be provided so as to cover the first piezoelectric element band and the opposite electrode. According to the configuration, the first piezoelectric element band can be protected from contact with the conveyed sheet.

The roller may be provided on the peripheral surface with a second piezoelectric element band shaped like a band for detecting contact with the leading end of the conveyed sheet in a conveying direction thereof so as to make a round around the axis in a contact area with the conveyed sheet. According to the configuration, while the first piezoelectric element band detects the side end of the conveyed sheet, the second piezoelectric element band can detect the end part of the conveyed sheet in the conveying direction thereof (leading end).

That is, in an end position detection method of a conveyed sheet using the sheet end detection device described above, using the sheet end detection device, based on the phase of the roller indicated by the phase detection unit when the first piezoelectric element band detects change in a contact state with the conveyed sheet, the axis direction position of the roller is acquired about the change position of the contact state with the conveyed sheet, thereby detecting the end position in a direction orthogonal to the conveying direction of the conveyed sheet, and based on the phase of the roller indicated by the phase detection unit when the second piezoelectric element band detects change in the contact state with the conveyed sheet, the end position of the conveyed sheet in the conveying direction thereof is detected.

Accordingly, the positions of the side end and the leading end (and the trailing end as required) of the conveyed sheet can be detected with high accuracy. Moreover, each of the first piezoelectric element hand and the second piezoelectric element band can be formed without providing a considerable number of piezoelectric elements independent of each other, so that it is easy to manufacture the first and second piezoelectric elements (band sheet end detection device) and the cost can also be reduced.

An image recording apparatus according to the embodiment includes any of the sheet end detection devices described above and a recording head for ejecting ink to a recording sheet as the conveyed sheet to form an image.

According to the configuration, the side end position of the conveyed sheet can be detected with good accuracy. Thus, for example, to execute borderless printing of a photo, etc., the space area and the print area to be set can be roughly matched with each other, so that waste ink can be suppressed, peripheral ink contamination can be decreased, and image loss in the space surrounding can be suppressed.

According to the sheet end detection device of the embodiment, the image recording apparatus including the sheet end detection device, and the end position detection method of a recording sheet using the sheet end detection device described above, it is made possible to facilitate manufacturing and suppress the manufacturing cost while the end position (particularly, side end position) of a conveyed sheet such as a recording sheet is detected more precisely.

What is claimed is:

1. A sheet end detection device comprising:

a cylindrical roller rotatable around an axis with conveying of a sheet to be conveyed in a state in which a peripheral surface of the roller contacts one face of the conveyed sheet;

a phase detection unit configured to detect a phase in a circumferential direction of the roller, wherein a first piezoelectric element band is provided on the peripheral surface of the roller and extending in the circumferential direction and the axial direction, the first piezoelectric element band being configured to detect a contact of the sheet and extending in an axial direction of the roller over an inside and an outside of a contact area to be contacted with the conveyed sheet on the peripheral surface, and wherein a position of an arbitrary point of the first piezoelectric element band in the axial direction of the roller corresponds one-to-one with the phase in the circumferential direction of the roller; and further comprising a processor and a memory, the memory storing a program that, when executed by the processor, causes the processor to detect a first signal indicating the detection of the contact of the sheet a first time and to determine and end position of the sheet based on detecting a second signal indicating the detection of the contact of the sheet a second time.

2. The sheet end detection device as claimed in claim 1, wherein the first piezoelectric element band spirally formed on the peripheral surface of the roller to extend one round around the axis of the roller.

3. The sheet end detection device as claimed in claim 1, wherein the first piezoelectric element band extends such that a position of the first piezoelectric element opposing a conveying passage of the conveyed sheet moves in a direction from an outer portion of the contact area to an inner portion in response to a rotation of the roller.

4. The sheet end detection device as claimed in claim 1, wherein the first piezoelectric element band extends such that a position of the first piezoelectric element opposed to the conveying passage of the conveyed sheet moves in a direction from an inner portion of the contact area toward an outer portion in response to a rotation of the roller.

5. The sheet end detection device as claimed in claim 3, wherein the roller has an outer circumferential dimension being a half or less of a dimension of the conveyed sheet in the conveying direction.

6. The sheet end detection device as claimed in claim 1, wherein the first piezoelectric element band extends such that a position of the first piezoelectric element opposed to the conveying passage of the conveyed sheet moves in a direction from an outer portion of the contact area to an inner portion and further to an outer portion in response to a rotation of the roller.

7. The sheet end detection device as claimed in claim 6, wherein the roller has an outer circumferential dimension equal to or less than a dimension of the conveyed sheet in the conveying direction.

8. The sheet end detection device as claimed in claim 1, wherein the peripheral surface of the roller contains metal and contacts with a back of the first piezoelectric element band to serve as one electrode, and wherein another electrode is provided on the surface of the first piezoelectric-crystal element band to extend along the first piezoelectric element band.

9. The sheet end detection device as claimed in claim 8, wherein an insulating cover is provided to cover the first piezoelectric element band and the another electrode.

10. The sheet end detection device as claimed in claim 1, further comprising a second piezoelectric element band provided on the peripheral surface of the roller, such that the second piezoelectric element makes a round around the axial direction in an area to be contact with the conveyed sheet.

11. The sheet end detection device as claimed in claim 1, wherein a plurality of the first piezoelectric element bands are arranged on the peripheral surface of the roller along the axial direction.

12. The sheet end detection device as claimed in claim 1, wherein a plurality of the first piezoelectric element bands are arranged on the peripheral surface of the roller along a direction perpendicular to the axial direction.

13. An image recording apparatus comprising;

a sheet end detection device as claimed in claim 1; and a recording head for ejecting ink to a recording sheet as the conveyed sheet to form an image, wherein the roller is provided at a midpoint in the conveying passage of the sheet to be conveyed.

14. A method for detecting an end position of a sheet using the sheet end detection device as claimed in claim 1, said method comprising:

detecting the phase of the roller by the phase detection unit;

detecting a contact state indicating whether the first piezoelectric element band with the sheet;

detecting the end position of the sheet in a direction orthogonal to the conveying direction by, when the first piezoelectric element band detects change in the contact state, a position of the roller in the axial direction at which the contact state is changed based on the phase of the roller detected by the phase detection unit.

15. The method as claimed in claim 14, wherein the sheet end diction device further comprises a second piezoelectric element band provided on the peripheral surface of the roller, such that the second piezoelectric element makes a round around the axial direction in an area to be contact with the conveyed sheet, and wherein said method further comprising detecting an end position of the sheet in the conveying direction, based on the phase of the roller detected by the phase detection unit when the second piezoelectric element band detects change in the contact state with the conveyed sheet.

16. A sheet end detection device comprising:

a cylindrical roller rotatable around an axis with conveying of a sheet to be conveyed in a state in which a peripheral surface of the roller contacts one face of the conveyed sheet;

a phase detection unit configured to detect a phase in a circumferential direction of the roller, wherein a first piezoelectric element band is provided on the peripheral surface of the roller and extending in the circumferential direction and the axial direction, the first piezoelectric element band being configured to detect a contact of the sheet and extending in an axial direction of the roller over an inside and an outside of a contact area to be contacted with the conveyed sheet on the peripheral surface, and wherein a position of an arbitrary point of the first piezoelectric element band in the axial direction of the roller corresponds one-to-one with the phase in the circumferential direction of the roller; and further comprising a processor and a memory, the memory storing a program that, when executed by the processor, causes the processor to monitor a detection signal indicating detection of the contact of the sheet and to determine an end position of the sheet when a state of the detection signal changes form a non-contact state to a contact state within one rotation of the roller.

* * * * *